US008598074B2

(12) United States Patent
Kawahara et al.

(10) Patent No.: US 8,598,074 B2
(45) Date of Patent: Dec. 3, 2013

(54) THERMOSENSITIVE RECORDING MEDIUM, IMAGE RECORDING METHOD AND IMAGE PROCESSING METHOD

(75) Inventors: Shinya Kawahara, Shizuoka (JP); Tomomi Ishimi, Shizuoka (JP); Toshiaki Asai, Shizuoka (JP); Yoshihiko Hotta, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 265 days.

(21) Appl. No.: 13/032,130

(22) Filed: Feb. 22, 2011

(65) Prior Publication Data

US 2011/0207603 A1 Aug. 25, 2011

(30) Foreign Application Priority Data

Feb. 23, 2010 (JP) ..... 2010-037632

(51) Int. Cl.
*B41M 5/46* (2006.01)

(52) U.S. Cl.
USPC ..... 503/201; 503/207; 503/226

(58) Field of Classification Search
None
See application file for complete search history.

(56) References Cited

U.S. PATENT DOCUMENTS

| | | | |
|---|---|---|---|
| 5,965,484 | A | 10/1999 | Kohno et al. |
| 6,432,518 | B1 | 8/2002 | Torii et al. |

FOREIGN PATENT DOCUMENTS

| | | | |
|---|---|---|---|
| CN | 101544141 | | 9/2009 |
| DE | 19810171 | A1 | 9/1998 |
| EP | 1016547 | A1 | 7/2000 |
| EP | 2311642 | A1 | 4/2011 |
| JP | 5-8537 | | 1/1993 |
| JP | 11-58985 | | 3/1999 |
| JP | 11-91243 | | 4/1999 |
| JP | 11-151856 | | 6/1999 |
| JP | 2000-136022 | | 5/2000 |
| JP | 2001-315447 | | 11/2001 |
| JP | 2004-265247 | | 9/2004 |
| JP | 2004-345273 | | 12/2004 |
| JP | 2005-238745 | | 9/2005 |
| JP | 2005-238746 | | 9/2005 |
| JP | 3790483 | | 4/2006 |
| JP | 2007-98735 | | 4/2007 |
| JP | 3998193 | | 8/2007 |
| JP | 4345520 | | 7/2009 |

OTHER PUBLICATIONS

Jan. 30, 2012 European official action in connection with counterpart European patent application No. 11 250 207.5.
Apr. 18, 2011 European search report in connection with counterpart European patent application No. 11 25 0207.
Chinese official action dated Mar. 27, 2013 (and English translation) in corresponding Chinese patent application No. 2011 10 04 5909.5.

*Primary Examiner* — Bruce H Hess
(74) *Attorney, Agent, or Firm* — Cooper & Dunham LLP

(57) ABSTRACT

To provide a thermosensitive recording medium including: a support; an image recording layer on the support; and an inorganic material in particle form as a light-heat conversion material, wherein the inorganic material has a ratio of Y to X, represented by Y/X, of 2 or greater, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm.

10 Claims, 4 Drawing Sheets

THERMOSENSITIVE RECORDING MEDIUM, IMAGE RECORDING METHOD AND IMAGE PROCESSING METHOD

BACKGROUND OF THE INVENTION

1. Field of the Invention

The present invention relates to a thermosensitive recording medium which can be suitably used for one-time-only image recording and for repeated image recording and image erasure; an image recording method; and an image processing method.

2. Description of the Related Art

In the case where laser light is used for recording onto a thermosensitive recording medium, there is a technique of providing a light-heat conversion layer made of a metal film formed by vacuum vapor deposition of titanium, chromium, nickel, germanium, aluminum or the like (refer to Japanese Patent Application Laid-Open (JP-A) No. 05-8537). However, the light-heat conversion layer made of the metal film is problematic in that it has metallic luster and is therefore inferior in visibility, it peels off as time passes, etc.

To obtain a thermosensitive recording medium free of such problems, there is a technique of using an organic pigment, e.g., phthalocyanine, as a light-heat conversion material (refer to JP-A Nos. 11--151856, 2004-345273, 2005-238745 and 2005-238746). In this case, however, the organic pigment generally has low resistance to light and is problematic in that, especially when mixed with a leuco dye, the organic pigment decomposes with time owing to the interaction between the organic pigment and the leuco dye, thereby causing a decrease in absorption in the near-infrared region and thus a noticeable decrease in recording sensitivity and erasure sensitivity.

Nowadays, use of thermosensitive recording media as thermoreversible recording media in product delivery and distribution centers, etc. is becoming more and more popular (refer to JP-A Nos. 2000-136022 and 2004-265247 and Japanese Patent (JP-B) No. 3998193).

However, use of a thermoreversible recording medium including an organic pigment, e.g., phthalocyanine, as a light-heat conversion material has caused new problems in which the background discolors with time and additional writing is difficult after the thermoreversible recording medium has been left unattended in an outdoor environment, etc.

Hence, in reality, there is a demand for provision of a thermosensitive recording medium which exhibits superior technical effects; and an image recording method and an image processing method which use the thermosensitive recording medium. The superior technical effects include securing favorable visibility without metallic luster, coloration, etc., securing favorable recording sensitivity and erasure sensitivity without their temporal decrease, preventing temporal discoloration of the background, removing the difficulty in performing additional writing after the thermosensitive recording medium has been left unattended in an outdoor environment, etc., and preventing degradations, such as peeling off of a film, deformation and elongation, caused by repeated use of the thermosensitive recording medium.

BRIEF SUMMARY OF THE INVENTION

An object of the present invention is to provide a thermosensitive recording medium which exhibits superior technical effects; and an image recording method and an image processing method which use the thermosensitive recording medium. The superior technical effects include securing favorable visibility without metallic luster, coloration, etc., securing favorable recording sensitivity and erasure sensitivity without their temporal decrease, preventing temporal discoloration of the background, removing the difficulty in performing additional writing after the thermosensitive recording medium has been left unattended in an outdoor environment, etc., and preventing degradations, such as peeling off of a film, deformation and elongation, caused by repeated use of the thermosensitive recording medium.

Means for solving the above-mentioned problems are as follows.

<1> A thermosensitive recording medium including: a support; an image recording layer on the support; and an inorganic material in particle form as a light-heat conversion material, wherein the inorganic material has a ratio of Y to X, represented by Y/X, of 2 or greater, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm.

<2> The thermosensitive recording medium according to <1>, wherein the light-heat conversion material includes particles of at least one of a metal boride and a metal oxide.

<3> The thermosensitive recording medium according to <1> or <2>, wherein the image recording layer contains the light-heat conversion material which can absorb light in the near-infrared region and convert the light to heat.

<4> The thermosensitive recording medium according to any one of <1> to <3>, wherein the light-heat conversion material is at least one selected from the group consisting of a hexaboride, a tungsten oxide compound, antimony tin oxide (ATO), indium tin oxide (ITO) and zinc antimonate.

<5> The thermosensitive recording medium according to any one of <1> to <4>, wherein the image recording layer is a thermoreversible recording layer.

<6> The thermosensitive recording medium according to <5>, wherein the thermoreversible recording layer can reversibly change into a transparent state and a colored state according to temperature.

<7> The thermosensitive recording medium according to <6>, wherein the thermoreversible recording layer contains a leuco dye and a reversible developer.

<8> The thermosensitive recording medium according to <6>, wherein the thermoreversible recording layer contains a polymer and an organic low-molecular-weight material.

<9> An image recording method including: applying light to the thermosensitive recording medium according to any one of <1> to <8> so as to record an image on the thermosensitive recording medium.

<10> An image processing method including: applying light to the thermosensitive recording medium according to any one of <5> to <8> so as to carry out at least one of image recording and image erasure on the thermosensitive recording medium.

<11> The image processing method according to <10>, wherein the light applied to the thermosensitive recording medium is laser light.

<12> The image processing method according to <11>, wherein the laser light applied has a wavelength of 700 nm to 2,000 nm.

The present invention can solve the above-mentioned problems in related art and achieve the object of providing a thermosensitive recording medium which exhibits superior technical effects; and an image recording method and an image processing method which use the thermosensitive recording medium. The superior technical effects include securing favorable visibility without metallic luster, coloration, etc., securing favorable recording sensitivity and erasure sensitivity without their temporal decrease, preventing temporal discoloration of the background, removing the difficulty in performing additional writing after the thermosensitive recording medium has been left unattended in an outdoor environment, etc., and preventing degradations, such as peeling off of a film, deformation and elongation, caused by repeated use of the thermosensitive recording medium.

DETAILED DESCRIPTION OF THE INVENTION (Thermosensitive Recording Medium)

A thermosensitive recording medium of the present invention is not particularly limited and may be suitably selected according to the intended purpose, provided that the thermosensitive recording medium includes an inorganic material in particle form as a light-heat conversion material, wherein the inorganic material has a ratio of Y to X, represented by Y/X, of 2 or greater, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm. It is preferred that the light-heat conversion material be contained in either or both of the after-mentioned image recording layer and light-heat conversion layer of the thermosensitive recording medium, and particularly preferred in view of securing favorable recording sensitivity that the light-heat conversion material be contained in the image recording layer.

The thermosensitive recording medium includes a support and an image recording layer on one surface of the support, preferably includes a light-heat conversion layer, an oxygen-insulating layer, an ultraviolet-absorbing layer, an intermediate layer and a protective layer, and may if necessary include other layers such as an undercoat layer, a back layer, an adhesive layer, a sticky layer, a colored layer, an air layer and a light-reflecting layer. These layers may each have a single-layer structure or a laminated structure.

The thermosensitive recording medium of the present invention can be used both in an aspect where the thermosensitive recording medium includes a thermosensitive recording layer as the image recording layer and performs image recording only once and in an aspect where the thermosensitive recording medium includes a thermoreversible recording layer as the image recording layer and repeatedly performs image recording and image erasure. It is particularly preferred in terms of capability of repeated use that the thermosensitive recording medium be a thermoreversible recording medium that allows image recording and image erasure to be repeatedly carried out thereon.

—Layer Structure—

Figure 1:
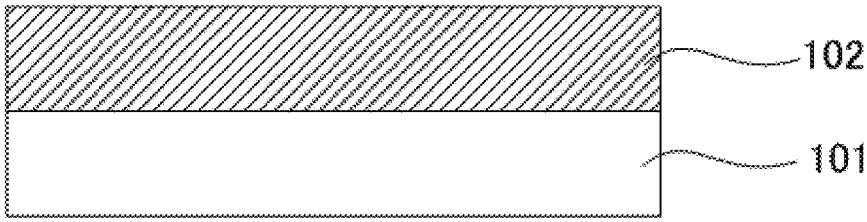
FIG. 1 is a schematic drawing showing an example of a layer structure of a thermosensitive recording medium.

Here, regarding the layer structure of a thermosensitive recording medium 100 of the present invention, there is an aspect where the thermosensitive recording medium includes a support 101 and an image recording layer 102 on the support, as shown in FIG. 1.

Figure 2A:
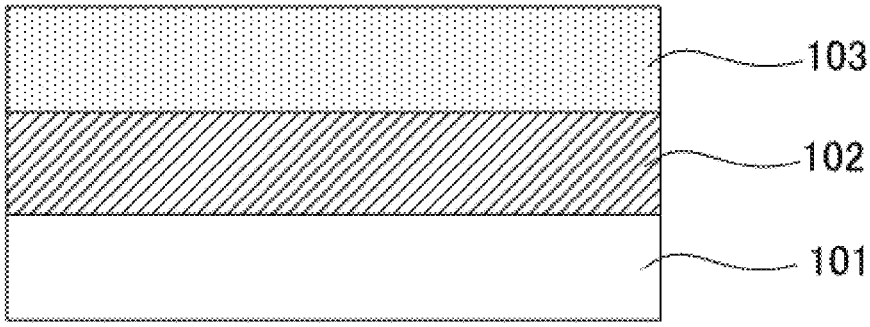
FIG. 2A is a schematic drawing showing another example of a layer structure of a thermosensitive recording medium.
Figure 2B:
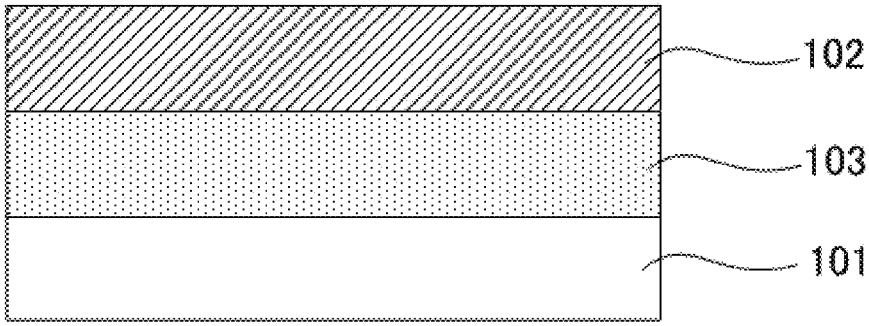
FIG. 2B is a schematic drawing showing yet another example of a layer structure of a thermosensitive recording medium.

Also, there is an aspect where the thermosensitive recording medium includes a support 101 and also includes, over the support, an image recording layer 102 and a light-heat conversion layer 103 in this order as shown in FIG. 2A, and there is an aspect where the thermosensitive recording medium includes a support 101 and also includes, over the support, a light-heat conversion layer 103 and an image recording layer 102 in this order as shown in FIG. 2B.

Figure 2C:
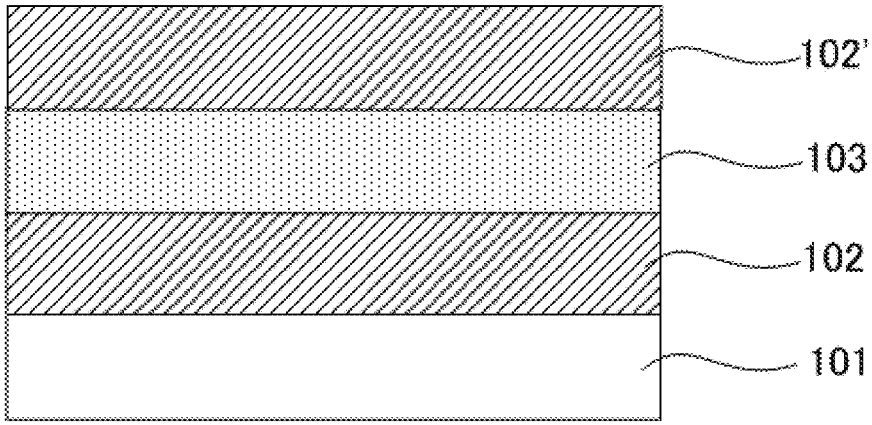
FIG. 2C is a schematic drawing showing yet another example of a layer structure of a thermosensitive recording medium.

Further, there is an aspect where the thermosensitive recording medium includes a support 101 and also includes, over the support, a first image recording layer 102, a light-heat conversion layer 103 and a second image recording layer 102' in this order as shown in FIG. 2C.

Note that although not shown in the drawings, at least one of an underlayer and an oxygen-insulating layer may be provided between the support and the image recording layer, at least one of an ultraviolet-absorbing layer and an oxygen-insulating layer may be provided on the image recording layer or the light-heat conversion layer, and at least one of a back layer and an oxygen-insulating layer may be provided on the surface of the support where the image recording layer is not provided.

—Light-Heat Conversion Layer—

As the light-heat conversion material, an inorganic material in particle form is used which has a ratio of Y to X (Y/X) of 2 or greater, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm. The ratio (Y/X) is preferably 2.2 or greater, more preferably 2.4 or greater. When the ratio (Y/X) is less than 2, it is necessary to increase absorption in the near-infrared region in order to secure sufficient recording sensitivity, and if the amount of the light-heat conversion material added is increased due to the foregoing, the background may be colored to a great extent.

Regarding the ratio (Y/X), the smaller the value of X is, the more favorable (for example, the value of X is most preferably 0); thus, the larger the ratio (Y/X) is, the more favorable. Accordingly, it is not necessary to set an upper limit value for the ratio (Y/X).

The average value of the absorption intensities with respect to light having wavelengths in the range of 400 nm to 700 nm, and the maximum value among the absorption intensities with respect to light having wavelengths greater than 700 nm but smaller than or equal to 1,200 nm can be measured with a spectrophotometer or the like, for example.

The light-heat conversion material may include particles of at least one of a metal boride and a metal oxide, for example.

As the metal boride or the metal oxide, preference is given to at least one selected from the group consisting of a hexaboride, a tungsten oxide compound, antimony tin oxide (ATO), indium tin oxide (ITO) and zinc antimonate.

The light-heat conversion material including particles of at least one of such metal borides and such metal oxides has the following advantages: the light-heat conversion material is highly resistant to light and heat, as opposed to organic pigments such as phthalocyanine; when the light-heat conversion material is mixed with a leuco dye, there is no interaction between the light-heat conversion material and the leuco dye; the light-heat conversion material does not decrease in its absorption of light in the near-infrared region even when exposed to sunlight over a long period of time or repeatedly irradiated with laser light; and thus a thermosensitive recording medium with high light resistance and high durability can be obtained.

Examples of the hexaboride include $LaB_6$, $CeB_6$, $PrB_6$, $NdB_6$, $GdB_6$, $TbB_6$, $DyB_6$, $HoB_6$, $YB_6$, $SmB_6$, $EuB_6$, $ErB_6$, $TmB_6$, $YbB_6$, $LuB_6$, $SrB_6$, $CaB_6$ and $(La, Ce)B_6$. Among these, $LaB_6$ is particularly preferable in that it has great absorption in the near-infrared region.

Examples of the tungsten oxide compound include fine particles of tungsten oxides represented by the general formula WyOz (where W denotes tungsten, O denotes oxygen, and y and z satisfy the relationship $2.2 \leq z/y \leq 2.999$), and fine particles of composite tungsten oxides represented by the general formula MxWyOz (where M denotes one or more elements selected from the group consisting of H, He, alkali metals, alkaline earth metals, rare-earth elements, Mg, Zr, Cr, Mn, Fe, Ru, Co, Rh, Ir, Ni, Pd, Pt, Cu, Ag, Au, Zn, Cd, Al, Ga, In, Tl, Si, Ge, Sn, Pb, Sb, B, F, P, S, Se, Br, Te, Ti, Nb, V, Mo, Ta, Re, Be, Hf, Os, Bi and I, W denotes tungsten, O denotes oxygen, and x, y and z satisfy the relationships $0.001 \leq x/y \leq 1$ and $2.2 \leq z/y \leq 3.0$), as mentioned in International Publication No. WO/2005/037932, JP-A No. 2005-187323 and so forth. Among these examples, cesium-containing tungsten oxides are particularly preferable in that they have great absorption in the near-infrared region and low absorption in the visible region.

Particularly preferable among antimony tin oxide (ATO), indium tin oxide (ITO) and zinc antimonate is ITO in terms of the fact that it has great absorption in the near-infrared region and low absorption in the visible region.

Since the light-heat conversion material including particles of at least one of the metal boride and the metal oxide has absorption in the near-infrared region, i.e., between 700 nm and 2,000 nm, favorable recording sensitivity can be secured by adjusting the wavelength of laser light, used to record and erase an image, to the foregoing wavelength range.

In order to reduce absorption of light in the visible region by the light-heat conversion material including particles of at least one of the metal boride and the metal oxide, it is preferred that the average particle diameter of the light-heat conversion material be 800 nm or less, more preferred in terms of reduction in scattering caused by the particles that the average particle diameter thereof be 200 nm or less, and even more preferred in terms of great reduction of scattered light that the average particle diameter thereof be 100 nm or less. Also, the lower limit value of the average particle diameter is preferably 1 nm or greater.

Here, the average particle diameter can be measured using a laser diffraction/scattering particle size distribution measuring apparatus, for example.

Although the amount of the light-heat conversion material including particles of at least one of the metal boride and the metal oxide cannot be unequivocally determined because it varies depending upon the type of the light-heat conversion material, etc., the amount is preferably in the range of 0.005 $g/m^2$ to 20 $g/m^2$, more preferably 0.01 $g/m^2$ to 10 $g/m^2$, with respect to the layer containing the light-heat conversion material. When the amount is less than 0.005 $g/m^2$, it may be impossible to secure sufficient recording sensitivity. When the amount is greater than 20 $g/m^2$, the background may be colored to a great extent and the contrast of an image may lower, since the light-heat conversion material has slight absorption in the visible region.

Regarding the light-heat conversion material including particles of at least one of the metal boride and the metal oxide, one light-heat conversion material may be solely used or two or more light-heat conversion materials may be used in combination.

Since the hexaboride and the tungsten oxide compound make it possible to secure sufficient absorption in the near-infrared region even when contained in small amounts, they can efficiently convert laser light they have absorbed to heat, and they hardly affect the recording sensitivity; however, the color tones thereof often vary between blue and green because they have slight absorption in the vicinity of 700 nm. Meanwhile, ATO, ITO and zinc antimonate do not have much absorption in the visible region, i.e., between 380 nm and 700 nm, and do not have much absorption in the near-infrared region either, so that when any of these compounds is used, it is necessary to increase the amount thereof.

Accordingly, by combining at least one of a hexaboride and a tungsten oxide compound with at least one of ATO, ITO and zinc antimonate, it is possible to secure sufficient absorption in the near-infrared region and reduce absorption in the visible region and the amounts thereof contained.

<Support>

The shape, structure, size, etc. of the support are not particularly limited and may be suitably selected according to the intended purpose. Examples of the shape include those of flat plates. The structure may be a single-layer structure or may be a laminated structure. The size may be suitably selected according, for example, to the size of the thermosensitive recording medium.

Examples of the material for the support include inorganic materials and organic materials.

Specific examples of the inorganic materials include glass, quartz, silicon, silicon oxide, aluminum oxide, $SiO_2$ and metals.

Specific examples of the organic materials include paper, cellulose derivatives such as cellulose triacetate, synthetic paper, and films of polyethylene terephthalate, polycarbonate, polystyrene, polymethyl methacrylate, etc.

The inorganic materials and the organic materials may be used individually or in combination. Preferable among these are organic materials, or more specifically, films of polyethylene terephthalate, polycarbonate, polymethyl methacrylate, etc., particularly polyethylene terephthalate.

For the purpose of improving adhesion of an applied layer to the support, it is preferred that the support be subjected to surface modification by corona discharge treatment, oxidation reaction treatment (with chromic acid, etc.), etching treatment, treatment for improved adhesion, antistatic treatment, etc.

Also, it is preferable to add a white pigment or the like, e.g., titanium oxide, to the support such that the support turns white.

The thickness of the support is not particularly limited and may be suitably selected according to the intended purpose; it is preferably in the range of 10 μm to 2,000 μm, more preferably 50 μm to 1,000 μm.

<Image Recording Layer>

The image recording layer serves as a thermosensitive recording layer in the case of one-time-only recording and serves as a thermoreversible recording layer in the case where image recording and image erasure are repeatedly carried out. The thermosensitive recording layer and the thermoreversible recording layer will be separately explained below.

<<Thermosensitive Recording Layer>>

The thermosensitive recording layer contains at least a leuco dye, a developer and a binder resin and may, if necessary, contain other components as well.

In the case where the light-heat conversion material including particles of at least one of the metal boride and the metal oxide is contained in a particle state in the thermosensitive recording layer, the amount of the light-heat conversion material contained is preferably in the range of 0.005 $g/m^2$ to 20 $g/m^2$, more preferably 0.01 $g/m^2$ to 10 $g/m^2$.

—Leuco Dye—

The leuco dye is not particularly limited and may be suitably selected from those commonly used as thermosensitive recording materials, according to the intended purpose. Preferred examples thereof include leuco compounds of triphenylmethane-based dyes, fluoran-based dyes, phenothiazine-based dyes, auramine-based dyes, spiropyran-based dyes and indolinophthalide-based dyes.

Specific examples of such leuco dyes include 2-anilino-3-methyl-6-dibutylaminofluoran,
3,3-bis(p-dimethylaminophenyl)-phthalide,
3,3-bis(p-dimethylaminophenyl)-6-dimethylaminophthalide (otherwise called "crystal violet lactone"),
3,3-bis-(p-dimethylaminophenyl)-6-diethylaminophthalide,
3,3-bis-(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran, 3-diethylamino-7-chlorofluoran,
3-diethylamino-7-methylfluoran, 3-diethylamino-7,8-benzofluoran,
3-diethylamino-6-methyl-7-chlorofluoran,
3-(N-p-tolyl-N-ethylamino)-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam], 3-diethylamino-6-methyl-7-(m-trichloromethylanilino)fluoran,
3-diethylamino-7-(o-chloroanilino)fluoran,
3-pyrrolidino-6-methyl-7-anilinofluoran,
3-di-n-butylamino-7-o-chloroanilinofluoran,
3-N-methyl-N,n-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino) fluoran, benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-(N-ethyl-N-tetrahydrofurfuryl)amino-6-methyl-7-anilinofluoran,
3-N-ethyl-N-(2-ethoxypropyl)amino-6-methyl-7-anilinofluoran,
3-N-methyl-N-isobutyl-6-methyl-7-anilinofluoran,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-di-n-butylamino-6-methyl-7-anilinofluoran,
3,6-bis-(dimethylamino)fluorenespiro(9,3')-6'-dimethylaminophthalide,
3-(N-benzyl-N-cyclohexylamino)-5,6-benzo-7-α-naphthylamino-4'-bromofluoran, 3-diethylamino-6-chloro-7-anilinofluoran,
3-diethylamino-6-methyl-7-mesitydino-4',5'-benzofluoran,
3-N-methyl-N-isopropyl-6-methyl-7-anilinofluoran,
3-N-ethyl-N-isoamyl-6-methyl-7-anilinofluoran,
3-diethylamino-6-methyl-7-(2',4'-dimethylanilino)fluoran,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-N-butylanilino)fluoran,
3,6-bis(dimethylamino)fluorenspiro(9,3')-6'-dimethylaminophthalide,
3-(N-benzyl-N-cyclohexylamino)-5,6-benzo-7-α-naphthylamino-4'-bromofluoran, 3-diethylamino-6-chloro-7-anilinofluoran,
3-N-ethyl-N-(2-ethoxypropyl)amino-6-methyl-7-anilinofluoran,
3-N-ethyl-N-tetrahydrofurfurylamino-6-methyl-7-anilinofluoran,
3-diethylamino-6-methyl-7-mesitydino-4',5'-benzofluoran,
3-(p-dimethylaminophenyl)-3-[1,1-bis(p-dimethylaminophenyl)ethylene-2-yl]phthalide,
3-(p-dimethylaminophenyl)-3-[1,1-bis(p-dimethylaminophenyl)ethylene-2-yl]-6-dimethylaminophthalide,
3-(p-dimethylaminophenyl)-3-(1-p-dimethylaminophenyl-1-phenylethylene-2-yl)phthalide,
3-(p-dimethylaminophenyl)-3-(1-p-dimethylaminophenyl-1-p-chlorophenylethylene-2-yl)-6-dimethylaminophthalide,
3-(4'-dimethylamino-2'-methoxy)-3-(1"-p-dimethylaminophenyl-1"-p-chlorophenyl-1",3"-butadiene-4"-yl)benzophthalide, 3-(4'-dimethylamino-2'-benzyloxy)-3-(1"-p-dimethylaminophenyl-1"-phenyl-1",3"-butadiene-4"-yl)benzophthalide, 3-dimethylamino-6-dimethylamino-fluorene-9-spiro-3'-(6'-dimethylamino)phthalide, 3,3-bis-[2-(p-dimethylaminophenyl)-2-(p-methoxyphenyl)ethenyl]-4,5,6,7-tetrachlorophthalide, 3-bis[1,1-bis(4-pyrrolidinophenyl)ethylene-2-yl]-5,6-dichloro-4,7-dibromophthalide, bis(p-dimethylaminostyryl)-1-naphthalenesulfonylmethane and bis(p-dimethylaminostyryl)-1-p-tolylsulfonylmethane. These may be used individually or in combination.

—Developer—

As the developer, any type of oxidant or electron-accepting compound which allows the leuco dye to form color upon its contact with the leuco dye can be used, for example.

The developer is not particularly limited and may be suitably selected from known developers according to the intended purpose. Specific examples thereof include 4,4'-isopropylidenebisphenol, 4,4'-isopropylidenebis(o-methylphenol), 4,4'-sec-butylidenebisphenol, 4,4'-isopropylidenebis(2-tert-butylphenol), zinc p-nitrobenzoate, 1,3,5-tris(4-tert-butyl-3-hydroxy-2,6-dimethylbenzyl)isocyanuric acid, 2,2-(3,4'-dihydroxydiphenyl)propane, bis(4-hydroxy-3-methylphenyl)sulfide, 4-[β-(p-methoxyphenoxy)ethoxy]salicylic acid, 1,7-bis(4-hydroxyphenylthio)-3,5-dioxaheptane, 1,5-bis(4-hydroxyphenylthio)-5-oxapentane, phthalic acid monobenzyl ester monocalcium salt, 4,4'-cyclohexylidenediphenol, 4,4'-isopropylidenebis(2-chlorophenol), 2,2'-methylenebis(4-methyl-6-tert-butylphenol), 4,4'-butylidenebis(6-tert-butyl-2-methyl)phenol, 1,1,3-tris(2-methyl-4-hydroxy-5-tert-butylphenyl)butane, 1,1,3-tris(2-methyl-4-hydroxy-5-cyclohexylphenyl)butane, 4,4'-thiobis(6-tert-butyl-2-methyl)phenol, 4,4'-diphenolsulfone, 4-isopropoxy-4'-hydroxydiphenylsulfone(4-hydroxy-4'-isopropoxydiphenylsulfone), 4-benzyloxy-4'-hydroxydiphenylsulfone, 4,4'-diphenolsulfoxide, isopropyl p-hydroxybenzoate, benzyl p-hydroxybenzoate, benzyl protocatechuate, stearyl gallate, lauryl gallate, octyl gallate, 1,3-bis(4-hydroxyphenylthio)-propane, N,N'-diphenylthiourea, N,N'-di(m-chlorophenyl)thiourea, salicylanilide, bis-(4-hydroxyphenyl)acetic acid methyl ester, bis-(4-hydroxyphenyl)acetic acid benzyl ester, 1,3-bis(4-hydroxycumyl)benzene, 1,4-bis(4-hydroxycumyl)benzene, 2,4'-diphenolsulfone, 2,2'-diallyl-4,4'-diphenolsulfone, 3,4-dihydroxyphenyl-4'-methyldiphenylsulfone, zinc 1-acetyloxy-2-naphthoate, zinc 2-acetyloxy-1-naphthoate, zinc 2-acetyloxy-3-naphthoate, α,α-bis(4-hydroxyphenyl)-α-methyltoluene, antipyrine complex of zinc thiocyanate, tetrabromobisphenol A, tetrabromobisphenol S, 4,4'-thiobis(2-methylphenol), 4,4'-thiobis(2-chlorophenol), dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid, octacosylphosphonic acid, α-hydroxydodecylphosphonic acid, α-hydroxytetradecylphosphonic acid, α-hydroxyhexadecylphosphonic acid, α-hydroxyoctadecylphosphonic acid, α-hydroxyeicosylphosphonic acid, α-hydroxydocosylphosphonic acid, α-hydroxytetracosylphosphonic acid, dihexadecyl phosphate, dioctadecyl phosphate, dieicosyl phosphate, didocosyl phosphate, monohexadecyl phosphate, monooctadecyl phosphate, monoeicosyl phosphate, monodocosyl phosphate, methylhexadecyl phosphate, methyloctadecyl phosphate, methyleicosyl phosphate, methyldocosyl phosphate, amylhexadecyl phosphate, octylhexadecyl phosphate and laurylhexadecyl phosphate. These may be used individually or in combination.

The amount of the developer contained is preferably in the range of 1 part by mass to 20 parts by mass, more preferably 2 parts by mass to 10 parts by mass, relative to 1 part by mass of the leuco dye.

—Binder Resin—

The binder resin is not particularly limited and may be suitably selected from known binder resins according to the intended purpose. Examples thereof include polyvinyl alcohol, and starch or derivatives thereof; cellulose derivatives such as methoxy cellulose, hydroxyethyl cellulose, carboxymethyl cellulose, methyl cellulose and ethyl cellulose; water-soluble polymers such as sodium polyacrylate, polyvinylpyrrolidone, acrylamide-acrylic acid ester copolymer, acrylamide-acrylic acid ester-methacrylic acid terpolymer, styrene-maleic anhydride copolymer alkali salt, isobutylene-maleic anhydride copolymer alkali salt, polyacrylamide, sodium alginate, gelatin and casein; emulsions such as polyvinyl acetate, polyurethane, polyacrylic acid, polyacrylic acid ester, polymethacrylic acid ester, polybutyl methacrylate, vinyl chloride-vinyl acetate copolymer and ethylene-vinyl acetate copolymer; latexes such as styrene-butadiene copolymer and styrene-butadiene-acrylic copolymer; polyethylene, polyvinyl acetate, polyacrylamide, maleic acid copolymer, polyacrylic acid esters, polymethacrylic acid esters, vinyl chloride-vinyl acetate copolymer, styrene copolymers, polyesters, polyurethane, polyvinyl butyral, ethylcellulose, polyvinyl acetal, polyvinyl acetoacetal, polycarbonate, epoxy resins and polyamides. These may be used individually or in combination.

For the thermosensitive recording layer, a thermofusible material may be used as a sensitivity improver. Examples of the thermofusible material include fatty acids such as stearic acid and behenic acid; fatty acid amides such as stearic acid amide and palmitic acid amide; fatty acid metal salts such as zinc stearate, aluminum stearate, calcium stearate, zinc palmitate and zinc behenate; p-benzyl biphenyl, terphenyl, triphenylmethane, benzyl p-benzyloxybenzoate, β-benzyloxynaphthalene, β-naphthoic acid phenyl ester, 1-hydroxy-2-naphthoic acid phenyl ester, 1-hydroxy-2-naphthoic acid methyl ester, diphenyl carbonate, terephthalic acid dibenzyl ester, terephthalic acid dimethyl ester, 1,4-dimethoxynaphthalene, 1,4-diethoxynaphthalene, 1,4-dibenzyloxynaphthalene, 1,2-bis(phenoxy)ethane, 1,2-bis(3-methylphenoxy)ethane, 1,2-bis(4-methylphenoxy)ethane, 1,4-bis(phenoxy)butane, 1,4-bis(phenoxy)-2-butene, 1,2-bis(4-methoxyphenylthio)ethane, dibenzoylmethane, 1,4-bis(phenylthio)butane, 1,4-bis(phenylthio)-2-butene, 1,2-bis(4-methoxyphenylthio)ethane, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, 1,3-dibenzoyloxypropane, dibenzyl disulfide, 1,1-diphenylethanol, 1,1-diphenylpropanol, p-(benzyloxy)benzylalcohol, 1,3-diphenoxy-2-propanol, N-octadecylcarbamoyl-p-methoxycarbonylbenzene, N-octadecylcarbamoylbenzene, oxalic acid dibenzyl ester and 1,5-bis(p-methoxyphenyloxy)-3-oxapentane. These may be used individually or in combination.

Further, for the thermosensitive recording layer, auxiliary additive components such as a surfactant, a lubricant and a filler may, if necessary, be used. Examples of the lubricant include higher fatty acids or metal salts thereof, higher fatty acid amides, higher fatty acid esters, animal waxes, vegetable waxes, mineral waxes and petroleum waxes.

Examples of the filler include inorganic fine powder such as of calcium carbonate, silica, zinc oxide, titanium oxide, aluminum hydroxide, zinc hydroxide, barium sulfate, clay, kaolin, talc, surface-treated calcium and surface-treated silica; and organic fine powder such as of urea-formalin resin, styrene-methacrylic acid copolymer, polystyrene resin and vinylidene chloride resin.

The thermosensitive recording layer is not particularly limited and can be formed by a generally known method. For example, the thermosensitive recording layer can be formed by separately pulverizing and dispersing a leuco dye and a developer along with a binder resin and other components with the use of a dispersing machine such as a ball mill, an attritor or a sand mill such that the dispersion particle diameter ranges between 0.1 μm and 3 μm, then mixing the ingredients according to a predetermined formulation, if necessary along with a filler, a lubricant, etc., so as to prepare a thermosensitive recording layer coating liquid, and applying this liquid onto the support.

The thickness of the thermosensitive recording layer is not particularly limited and may be suitably selected according to the intended purpose. It is preferably in the range of 1 μm to 20 μm, more preferably 3 μm to 10 μm.

<<Thermoreversible Recording Layer>>

The thermoreversible recording layer contains a material whose transparency or color tone reversibly changes depending upon temperature, and may if necessary contain other components as well.

In the case where the light-heat conversion material including particles of at least one of the metal boride and the metal oxide is contained in a particle state in the thermoreversible recording layer, the amount of the light-heat conversion material contained is preferably in the range of 0.005 $g/m^2$ to 20 $g/m^2$, more preferably 0.01 $g/m^2$ to 10 $g/m^2$.

—Material whose Transparency or Color Tone Reversibly Changes Depending upon Temperature—

The material whose transparency or color tone reversibly changes depending upon temperature is a material capable of exhibiting a phenomenon which allows visible change(s) to take place reversibly according to temperature change, and capable of changing into a relatively color forming state and a relatively color erasing state depending upon heating temperature and the difference in cooling rate after heating. In this case, the visible changes can be divided into a change in the state of color and a change in shape. For example, the change in the state of color stems from a change in transmittance, a change in reflectance, a change in absorption wavelength, a change in the degree of scattering, etc. In effect, the thermoreversible recording medium changes in the state of color according to a combination of these changes.

The material whose transparency or color tone reversibly changes depending upon temperature is not particularly limited and may be suitably selected from known such materials. Among the known such materials, any material whose transparency or color tone reversibly changes depending upon a first specific temperature and a second specific temperature is particularly preferable in that temperature control is easy and high contrast can be obtained. Examples thereof include a material which gets into a transparent state at a first specific temperature and gets into a white turbid state at a second specific temperature (refer to JP-A No. 55-154198); a material which forms color at a second specific temperature and erases the color at a first specific temperature (refer to JP-A Nos. 04-224996, 04-247985 and 04-267190); a material which gets into a white turbid state at a first specific temperature and gets into a transparent state at a second specific temperature (refer to JP-A No. 03-169590); and a material which forms a color such as black, red or blue at a first specific temperature and erases the color at a second specific temperature (refer to JP-A Nos. 02-188293 and 02-188294).

Among these, any thermoreversible recording medium including a polymer (resin base material) and an organic low-molecular-weight material, such as a higher fatty acid, dispersed in the polymer is advantageous in that the second specific temperature and the first specific temperature are relatively low and thus erasure and recording are possible with low energy. Also, since the color-forming and color-erasing mechanism is a physical change which depends upon solidification of the resin and crystallization of the organic low-molecular-weight material, the thermoreversible recording medium has high environmental resistance.

Also, a thermoreversible recording medium which includes a leuco dye and a reversible developer, described later, and which forms color at a second specific temperature and erases the color at a first specific temperature exhibits a transparent state and a color forming state reversibly and exhibits the color of black, the color of blue or other color in the color forming state, thereby making it possible to obtain a high-contrast image.

The organic low-molecular-weight material (which is dispersed in the resin base material and which gets into a transparent state at the first specific temperature and gets into a white turbid state at the second specific temperature) in the thermosensitive recording medium is not particularly limited as long as it changes from a polycrystalline state to a monocrystalline state by heat in the thermoreversible recording layer, and the organic low-molecular-weight material may be suitably selected according to the intended purpose. Generally, organic low-molecular-weight materials having melting points in the approximate range of 30° C. to 200° C. are usable, with preference being given to those having melting points in the range of 50° C. to 150° C.

Such an organic low-molecular-weight material is not particularly limited and may be suitably selected according to the intended purpose. Examples thereof include alkanols; alkanediols; halogenated alkanols and halogenated alkanediols; alkylamines; alkanes; alkenes; alkines; halogenated alkanes; halogenated alkenes; halogenated alkines; cycloalkanes; cycloalkenes; cycloalkines; saturated or unsaturated monocarboxylic/dicarboxylic acids, and esters thereof, amides thereof or ammonium salts thereof; saturated or unsaturated halogenated fatty acids, and esters thereof, amides thereof or ammonium salts thereof; arylcarboxylic acids, and esters thereof, amides thereof or ammonium salts thereof; halogenated arylcarboxylic acids, and esters thereof, amides thereof or ammonium salts thereof; thioalcohols; thiocarboxylic acids, and esters thereof, amines thereof or ammonium salts thereof; and carboxylic acid esters of thioalcohols. These may be used individually or in combination.

These compounds each preferably have 10 to 60 carbon atoms, more preferably 10 to 38 carbon atoms, particularly preferably 10 to 30 carbon atoms. Alcohol groups in the esters may or may not be saturated, and may be halogen-substituted.

The organic low-molecular-weight material preferably contains in its molecule at least one selected from oxygen, nitrogen, sulfur and halogens, for example groups such as —OH, —COOH, —CONH—, —COOR, —NH—, —$NH_2$, —S—, —S—S— and —O—, halogen atoms, etc.

More specifically, examples of these compounds include higher fatty acids such as lauric acid, dodecanoic acid, myristic acid, pentadecanoic acid, palmitic acid, stearic acid, behenic acid, nonadecanoic acid, alginic acid and oleic acid; and esters of higher fatty acids such as methyl stearate, tetradecyl stearate, octadecyl stearate, octadecyl laurate, tetradecyl palmitate and dodecyl behenate. Preferable among these as organic low-molecular-weight materials are higher fatty acids, more preferably higher fatty acids each having 16 or more carbon atoms such as palmitic acid, stearic acid, behenic acid and lignoceric acid, even more preferably higher fatty acids each having 16 to 24 carbon atoms.

To widen the temperature range in which the thermosensitive recording medium can be made transparent, the above-mentioned organic low-molecular-weight materials may be used in a suitably combined manner, or the above-mentioned organic low-molecular-weight materials may be combined with other materials having different melting points. Examples of such materials include, but are not limited to, those disclosed in JP-A Nos. 63-39378 and 63-130380, JP-B No. 2615200, and so forth.

The polymer (resin base material) forms a layer in which the organic low-molecular-weight material is uniformly dispersed and held; also, the polymer affects the transparency of the medium when it is most transparent. Accordingly, the polymer is preferably a resin which is highly transparent, mechanically stable and favorable in terms of film forming properties.

Such a resin is not particularly limited and may be suitably selected according to the intended purpose. Examples thereof include polyvinyl chloride; vinyl chloride copolymers such as vinyl chloride-vinyl acetate copolymer, vinyl chloride-vinyl acetate-vinyl alcohol copolymer, vinyl chloride-vinyl acetate-maleic acid copolymer and vinyl chloride-acrylate copolymer; polyvinylidene chloride; vinylidene chloride copolymers such as vinylidene chloride-vinyl chloride copolymer and vinylidene chloride-acrylonitrile copolymer; polyesters; polyamides; polyacrylates, polymethacrylates and acrylate-methacrylate copolymers; and silicone resins. These may be used individually or in combination.

The proportion of the organic low-molecular-weight material to the polymer (resin base material) in the thermoreversible recording layer is preferably in the range of approximately 2:1 to 1:16, more preferably 1:2 to 1:8, as a mass ratio.

When the mass of the polymer is so small as to be outside the mass ratio of 2:1, it may be difficult to form a film in which the organic low-molecular-weight material is held in the polymer. When the mass of the polymer is so large as to be outside the mass ratio of 1:16, the amount of the organic low-molecular-weight material is small and thus it may be difficult to make the thermoreversible recording layer opaque.

Besides the organic low-molecular-weight material and the resin, other components such as a high-boiling-point solvent and a surfactant may be added to the thermoreversible recording layer to facilitate recording of a transparent image.

The method for producing the thermoreversible recording layer is not particularly limited and may be suitably selected according to the intended purpose. For example, the thermoreversible recording layer can be produced by a method wherein a solution in which two components, i.e., the polymer (resin base material) and the organic low-molecular-weight material, are dissolved, or a dispersion liquid obtained by dispersing the organic low-molecular-weight material in fine particle form in a solution of the polymer (in which the solvent does not dissolve at least one selected from the above-mentioned organic low-molecular-weight materials) is, for example, applied over the support and dried.

The solvent used to produce the thermoreversible recording layer is not particularly limited and may be suitably selected according to the types of the polymer and the organic low-molecular-weight material. Examples of the solvent include tetrahydrofuran, methyl ethyl ketone, methyl isobutyl ketone, chloroform, carbon tetrachloride, ethanol, toluene and benzene. In the case where the solution is used, as well as the case where the dispersion liquid is used, the organic low-molecular-weight material is deposited as fine particles and present in a dispersed state in the thermoreversible recording layer obtained.

Next, a thermoreversible recording layer which includes a leuco dye and a reversible developer and which forms color at a second specific temperature and erases the color at a first specific temperature will be explained.

The leuco dye is not particularly limited and may be suitably selected from known leuco dyes, and the leuco dye may be similar to the one for the thermosensitive recording layer.

The reversible developer is not particularly limited as long as it is capable of reversibly performing color formation and color erasure with heat as a factor, and the reversible developer may be suitably selected according to the intended purpose. Suitable examples thereof include a compound having in its molecule one or more structures selected from the following structures: a structure (1) having such color-developing ability as allows the leuco dye to form color (for example, a phenolic hydroxyl group, a carboxylic acid group, or a phosphoric acid group); and a structure (2) which regulates intermolecular aggregation, exemplified by a structure to which a long-chain hydrocarbon group is linked. Additionally, a divalent or higher linking group, including a hetero atom, may be present at the linking portion; also, at least one of a similar lining group and an aromatic group may be contained in the long-chain hydrocarbon group.

As the structure (1) having such color-developing ability as allows the leuco dye to form color, phenol is particularly preferable.

The structure (2) which regulates intermolecular aggregation is preferably a long-chain hydrocarbon group having 8 or more carbon atoms, more preferably 11 or more carbon atoms, with the upper limit of the number of carbon atoms being preferably 40 or fewer, more preferably 30 or fewer.

Among the above-mentioned reversible developers, phenol compounds represented by General Formula (1) below are preferred, and phenol compounds represented by General Formula (2) below are more preferred.

General Formula (1)

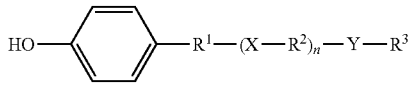

General Formula (2)

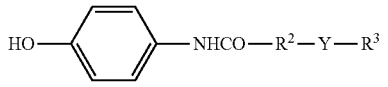

In General Formulae (1) and (2), $R^1$ denotes a single bond or an aliphatic hydrocarbon group having 1 to 24 carbon atoms. $R^2$ denotes an aliphatic hydrocarbon group having two or more carbon atoms, which may contain a substituent, and the number of the carbon atoms is preferably 5 or greater, more preferably 10 or greater. $R^3$ denotes an aliphatic hydrocarbon group having 1 to 35 carbon atoms, and the number of the carbon atoms is preferably in the range of 6 to 35, more preferably 8 to 35. These aliphatic hydrocarbon groups may be used individually or in combination.

The sum of the numbers of carbon atoms which $R^1$, $R^2$ and $R^3$ have is not particularly limited and may be suitably selected according to the intended purpose, with its lower limit being preferably 8 or greater, more preferably 11 or greater, and its upper limit being preferably 40 or less, more preferably 35 or less.

When the sum of the numbers of carbon atoms is less than 8, there may be a decrease in color forming stability and color erasing capability.

Each of the aliphatic hydrocarbon groups may be a straight-chain group or a branched-chain group and may have an unsaturated bond, with preference being given to a straight-chain group. Examples of the substituent bonded to the aliphatic hydrocarbon group include a hydroxyl group, halogen atoms and alkoxy groups.

X and Y may be identical or different, each denoting a nitrogen atom-containing or oxygen atom-containing divalent group. Specific examples thereof include an oxygen atom, an amide group, a urea group, a diacylhydrazine group, a diamide oxalate group and an acylurea group. Among these, an amide group and a urea group are preferable.

The letter n denotes an integer of 0 or 1.

It is preferred that the electron-accepting compound (developer) be used together with a compound having in its molecule one or more groups selected from —NHCO— group, —OCONH— group and —)— group and serving as a color erasure accelerator because intermolecular interaction is induced between the color erasure accelerator and the developer in a process of creating a color erasing state and thus there is an improvement in color-forming and color-erasing properties.

The color erasure accelerator is not particularly limited and may be suitably selected according to the intended purpose.

For the thermoreversible recording layer, a binder resin and, if necessary, additives for improving or regulating the application properties and/or color-forming and color-erasing properties of the thermoreversible recording layer may be used. Examples of these additives include a surfactant, a conductive agent, a filling agent, an antioxidant, a light stabilizer, a color formation stabilizer and a color erasure accelerator.

The binder resin is not particularly limited as long as it enables the thermoreversible recording layer to be bonded onto the support, and the binder resin may be suitably selected according to the intended purpose. For instance, one resin or a combination of two or more resins, among conventionally known resins, may be used. Among these, resins capable of curing by heat, an ultraviolet ray, an electron beam or the like are preferably used because they improve durability at the time of repeated use; in particular, resins produced using isocyanate-based compounds, etc. as cross-linking agents are preferable. Examples of the binder resin include a resin containing a group which reacts with a cross-linking agent, such as a hydroxyl group or carboxyl group, and a resin produced by copolymerizing a hydroxyl group-containing, carboxyl group-containing, etc. monomer with other monomer. Specific examples of such resins include phenoxy resins, polyvinyl butyral resins, cellulose acetate propionate resins, cellulose acetate butyrate resins, acrylic polyol resins, polyester polyol resins and polyurethane polyol resins. Particularly preferable among these are acrylic polyol resins, polyester polyol resins and polyurethane polyol resins.

The hydroxyl value of the binder resin is preferably in the range of 100 mgKOH/g to 300 mgKOH/g. When the hydroxyl value is less than 100 mgKOH/g, sufficient coating film strength may not be able to be secured, and the recording medium easily degrades when recording and erasure are repeatedly carried out. It is not preferred that the hydroxyl value be greater than 300 mgKOH/g because the formed film cannot be completely cross-linked and uncross-linked components adversely affect the color forming system. Moreover, the solubility of the binder resin in organic solvent may decrease and so the binder resin may not be able to be completely dissolved in the organic solvent.

The mixture proportion (mass ratio) of the leuco dye to the binder resin in the thermoreversible recording layer is preferably in the range of 1:0.1 to 1:10. When the proportion of the binder resin is too small, the thermoreversible recording layer may be deficient in thermal strength. When the proportion of the binder resin is too large, the color forming density may decrease, possibly causing a problem.

The cross-linking agent is not particularly limited and may be suitably selected according to the intended purpose, and examples thereof include isocyanates, amino resins, phenol resins, amines, epoxy compounds, organic titanium compounds and zirconium compounds. Among these, isocyanates are preferable, particularly polyisocyanate compounds each containing a plurality of isocyanate groups.

As for the amount of the cross-linking agent added with respect to the amount of the binder resin, the ratio of the number of functional groups contained in the cross-linking agent to the number of active groups contained in the binder resin is preferably in the range of 0.01:1 to 2:1. When the amount of the cross-linking agent added is smaller than mentioned above, there may be a deficiency of thermal strength. When the amount of the cross-linking agent added is larger than mentioned above, the color-forming and color-erasing properties may be adversely affected.

Additionally, as a cross-linking accelerator, any catalyst utilized in this sort of reaction may be used.

The gel fraction of the resin, when thermally cross-linked, is preferably 30% or greater, more preferably 50% or greater, even more preferably 70% or greater. When the gel fraction is less than 30%, a sufficiently cross-linked state may not be secured, thereby leading to inferiority in terms of durability.

As a method for distinguishing whether the binder resin is in a cross-linked state or a non-crosslinked state, there is, for example, a method of immersing the coating film in a solvent having high dissolving capability. In other words, the binder resin in a non-crosslinked state dissolves in the solvent and thus does not remain in the solute.

The above-mentioned other components optionally used in the thermoreversible recording layer are not particularly limited and may be suitably selected according to the intended purpose. For example, a surfactant, a plasticizer, etc. may be used in view of facilitation of image recording.

As a solvent used for a coating liquid for the thermoreversible recording layer, a device for dispersing the coating liquid, a method of applying the thermoreversible recording layer, a method of drying and curing the thermoreversible recording layer, etc., those that are known may be used.

Also, regarding the coating liquid for the thermoreversible recording layer, materials may be dispersed into solvent using the dispersing device; alternatively, the materials may be independently dispersed into solvent and then mixed together. Further, the materials may be heated and dissolved, then deposited by rapid cooling or slow cooling.

The method for forming the thermoreversible recording layer is not particularly limited and may be suitably selected according to the intended purpose. Suitable examples thereof include a method (1) in which a coating liquid for a thermoreversible recording layer, obtained by dissolving or dispersing the resin, an electron-donating color-generating compound and the electron-accepting compound in a solvent, is applied onto a support, and the coating liquid is cross-linked while or after formed into a sheet or the like by evaporation of the solvent; a method (2) in which a coating liquid for a thermoreversible recording layer, obtained by dispersing an electron-donating color-generating compound and the electron-accepting compound in a solvent dissolving the resin only, is applied onto a support, and the coating liquid is cross-linked while or after formed into a sheet or the like by evaporation of the solvent; and a method (3) of not using solvent but heating and melting the resin, an electron-donating color-generating compound and the electron-accepting compound and mixing them together, then cross-linking this melted mixture after forming it into a sheet or the like and cooling it. Note that, in these methods, it is also possible to form a sheet-like thermoreversible recording medium without using the support.

The solvent used in (1) or (2) above cannot be unequivocally determined, as it varies depending upon the types, etc. of the resin, the electron-donating color-generating compound and the electron-accepting compound. Examples of the solvent include tetrahydrofuran, methyl ethyl ketone, methyl isobutyl ketone, chloroform, carbon tetrachloride, ethanol, toluene and benzene.

Parenthetically, the electron-accepting compound is present in particle form and in a dispersed manner in the thermoreversible recording layer.

Pigment(s), an antifoaming agent, a dispersant, a slip agent, an antiseptic agent, a cross-linking agent, a plasticizer, etc. may be added to the coating liquid for the thermoreversible recording layer, for the purpose of exhibiting high performance as a coating material.

The method of applying the thermoreversible recording layer is not particularly limited and may be suitably selected according to the intended purpose. For instance, a support which is continuous in the form of a roll or which has been cut into the form of a sheet is conveyed, and the thermoreversible recording layer is applied onto the support by a known method such as blade coating, wire bar coating, spray coating, air knife coating, bead coating, curtain coating, gravure coating, kiss coating, reverse roll coating, dip coating or die coating.

Drying conditions for the coating liquid for the thermoreversible recording layer are not particularly limited and may be suitably selected according to the intended purpose. For example, the drying temperature is set between room temperature and 140° C., and the drying time is set between approximately 10 seconds and approximately 10 minutes.

The thickness of the thermoreversible recording layer is not particularly limited and may be suitably selected according to the intended purpose. For example, the thickness is preferably in the range of 1 μm to 20 μm, more preferably 3 μm to 15 μm. When the thermoreversible recording layer is too thin, the contrast of an image may be low because the color forming density is low. When the thermoreversible recording layer is too thick, the heat distribution in the layer widens, so that there are portions which do not reach a color forming temperature and thus do not form color, thereby possibly making it impossible to secure a desired color forming density.

In the case where the after-mentioned light-heat conversion layer is provided, a first thermoreversible recording layer and a second thermoreversible recording layer may be provided such that the light-heat conversion layer is sandwiched therebetween, although the manner in which these layers are provided is not particularly limited. This makes it possible to efficiently utilize heat generated by the light-heat conversion layer and thus to secure favorable recording sensitivity.

In the case where the first thermoreversible recording layer and the second thermoreversible recording layer are provided, the thickness of the first thermoreversible recording layer is preferably in the range of 0.1 μm to 15 μm, and the thickness of the second thermoreversible recording layer is preferably in the range of 0.1 μm to 15 μm.

<Light-heat Conversion Layer>

The light-heat conversion layer contains a binder resin, and the light-heat conversion material including particles of at least one of the metal boride and the metal oxide, and may, if necessary, contain other components. The light-heat conversion material is contained in a particle state in the light-heat conversion layer.

The amount of the light-heat conversion material contained is preferably in the range of 0.005 $g/m^2$ to 20 $g/m^2$, more preferably 0.01 $g/m^2$ to 10 $g/m^2$.

—Binder Resin—

The binder resin is not particularly limited and may be suitably selected from known binder resins as long as it can hold the light-heat conversion material. The binder resin is preferably a thermoplastic resin, a thermosetting resin or the like, and any resin similar to the binder resin used for the above-mentioned image recording layer can be suitably used. Among these resins, any resin capable of curing by heat, an ultraviolet ray, an electron beam, etc. is preferably used because it improves durability at the time of repeated use; in particular, preference is given to any thermally cross-linked resin produced using an isocyanate-based compound, etc. as a cross-linking agent. The hydroxyl value of the binder resin is preferably in the range of 100 mgKOH/g to 300 mgKOH/g.

The mixture proportion (mass ratio) of the light-heat conversion material to the binder resin in the light-heat conversion layer is preferably in the range of 0.1:0.1 to 0.1:100 because the extent of absorption of light in the visible region by the light-heat conversion material is small, and favorable recording sensitivity and sufficient coating film strength can be secured. When the proportion of the binder resin is too small, the light-heat conversion layer may be deficient in thermal strength. When the proportion of the binder resin is too large, the recording sensitivity may decrease, possibly causing a problem.

The above-mentioned other components optionally contained in the light-heat conversion layer are not particularly limited and may be suitably selected according to the intended purpose, and conventionally known additives, pigments, etc. may be used.

As a solvent used for a coating liquid for the light-heat conversion layer, a device for dispersing the coating liquid, a method of applying the light-heat conversion layer, a method of drying and cross-linking the light-heat conversion layer, etc., those that are known may be used.

The thickness of the light-heat conversion layer is not particularly limited and may be suitably selected according to the intended purpose; nevertheless, the thickness is preferably in the range of 0.1 μm to 30 μm, more preferably 0.5 μm to 20 μm.

<Ultraviolet-absorbing Layer>

In the present invention, for the purpose of preventing coloration of the leuco dye in the image recording layer caused by an ultraviolet ray, and preventing an image from remaining instead of being erased, which is caused by optical degradation, it is preferable to provide an ultraviolet-absorbing layer, which makes it possible to enhance the light resistance of the thermosensitive recording medium.

The ultraviolet-absorbing layer contains at least a binder resin and an ultraviolet absorber and may, if necessary, contain other components such as a filler, a lubricant and a coloring pigment.

The binder resin is not particularly limited and may be suitably selected according to the intended purpose, and the binder resin used for the image recording layer or a resin component such as a thermoplastic resin or thermosetting resin may be used. Examples of the resin component include polyethylene, polypropylene, polystyrene, polyvinyl alcohol, polyvinyl butyral, polyurethane, saturated polyesters, unsaturated polyesters, epoxy resins, phenol resins, polycarbonates and polyamides.

As the ultraviolet absorber, both organic and inorganic compounds are usable.

Also, it is preferable to use a polymer having an ultraviolet-absorbing structure (hereinafter referred to also as "ultraviolet-absorbing polymer").

Here, the polymer having an ultraviolet-absorbing structure means a polymer having an ultraviolet-absorbing structure, e.g., an ultraviolet-absorbing group, in its molecule. Examples of the ultraviolet-absorbing structure include a salicylate structure, a cyanoacrylate structure, a benzotriazole structure and a benzophenone structure. Among these, a benzotriazole structure and a benzophenone structure are particularly preferable in that they absorb ultraviolet rays in the wavelength range of 340 nm to 400 nm that causes optical degradation of the leuco dye.

The ultraviolet-absorbing polymer is preferably cross-linked. Accordingly, as the ultraviolet-absorbing polymer, use of a polymer containing a group which reacts with a curing agent, e.g., a hydroxyl group, amino group or carboxyl group, is preferable, and a hydroxyl group-containing polymer is particularly preferable. To improve the strength of the layer containing the polymer having an ultraviolet-absorbing structure, it is preferable to use a polymer whose hydroxyl value is 10 mgKOH/g or greater, more preferably 30 mgKOH/g or greater, even more preferably 40 mgKOH/g or greater, because sufficient coating film strength can be secured. By allowing the layer to have sufficient coating film strength, it is possible to reduce degradation of the recording medium even when erasure and recording are repeatedly carried out.

The thickness of the ultraviolet-absorbing layer is preferably in the range of 0.1 μm to 30 μm, more preferably 0.5 μm to 20 μm. As a solvent used for a coating liquid for the ultraviolet-absorbing layer, a device for dispersing the coating liquid, a method of applying the ultraviolet-absorbing layer, a method of drying and curing the ultraviolet-absorbing layer, etc., those that are known and used for the thermoreversible recording layer may be used.

<Protective Layer>

For the purpose of protecting the image recording layer, the thermosensitive recording medium of the present invention may be provided with a protective layer over the image recording layer. The protective layer is not particularly limited and may be suitably selected according to the intended purpose. For example, one or more protective layers may be formed, and the protective layer(s) is/are preferably provided at the exposed outermost surface.

The protective layer contains a binder resin and may, if necessary, contain other components such as a filler, a lubricant and a coloring pigment.

The binder resin contained in the protective layer is not particularly limited and may be suitably selected according to the intended purpose. For example, the binder resin is preferably a thermosetting resin, an ultraviolet (UV) curable resin, an electron beam curable resin, etc., with an ultraviolet (UV) curable resin and a thermosetting resin being particularly preferable.

The UV curable resin can form a very hard film after cured and can suppress damage caused by physical contact of the surface and deformation of the medium caused by laser heating, and thus a thermoreversible recording medium superior in durability against repeated use can be obtained.

Although slightly inferior to the UV curable resin, the thermosetting resin can similarly harden the surface and is superior in durability against repeated use. For example, as the thermosetting resin, any resin similar to the binder resin used for the thermoreversible recording layer can be suitably used.

The UV curable resin is not particularly limited and may be suitably selected from known UV curable resins according to the intended purpose. Examples thereof include oligomers based upon unsaturated polyesters, vinyls, polyether acrylates, polyester acrylates, epoxy acrylates and urethane acrylates; and monofunctional or polyfunctional monomers such as acrylates, methacrylates, vinyl esters, ethylene derivatives and allyl compound. Among these, tetrafunctional or higher monomers or oligomers are particularly preferable. By mixing two or more of these monomers or oligomers, it is possible to adjust the hardness, contraction degree, flexibility, coating film strength, etc. of the resin film.

To cure the monomer or the oligomer using an ultraviolet ray, it is necessary to use a photopolymerization initiator and/or a photopolymerization accelerator.

The amount of the photopolymerization initiator and/or the photopolymerization accelerator added is preferably in the range of 0.1% by mass to 20% by mass, more preferably 1% by mass to 10% by mass, relative to the total resin content of the protective layer.

Ultraviolet irradiation for curing the ultraviolet curable resin can be performed by using a known ultraviolet irradiation apparatus, and examples of this apparatus include those equipped with a light source, a lamp, a power source, a cooling device, a conveyance device, etc.

Examples of the light source include mercury lamps, metal halide lamps, potassium lamps, mercury xenon lamps and flash lamps. The wavelength of the light source may be suitably selected according to the ultraviolet absorption wavelength(s) of the photopolymerization initiator and/or the photopolymerization accelerator added to the composition for the thermoreversible recording medium.

Conditions for the ultraviolet irradiation are not particularly limited and may be suitably selected according to the intended purpose. For example, it is advisable to decide the lamp output, the conveyance speed, etc. according to the irradiation energy necessary to cross-link the resin.

Also, to improve conveyance capability, a release agent, e.g., a polymerizable group-containing silicone, a silicone-grafted polymer, a wax or zinc stearate, and/or a lubricant, e.g., silicone oil, may be added. The amount of the release agent and/or the lubricant added is preferably in the range of 0.01% by mass to 50% by mass, more preferably 0.1% by mass to 40% by mass, relative to the total mass of the resin content of the protective layer. Regarding the release agent and/or the lubricant, one compound may be solely used or two or more compounds may be used in combination. Also, as a countermeasure against static electricity, use of a conductive filler is preferable, more preferably a needle-like conductive filler.

The resin contained in the protective layer is preferably cross-linked, and use of a compound containing a group reactive with a curing agent, such as a hydroxyl group, amino group or carboxyl group, is preferable, particularly a polymer containing a hydroxyl group.

The particle diameter of the conductive filler is preferably in the range of 0.01 μm to 10.0 μm, more preferably 0.05 μm to 8.0 μm. The amount of the conductive filler added is preferably in the range of 0.001 parts by mass to 2 parts by mass, more preferably 0.005 parts by mass to 1 part by mass, relative to 1 part by mass of the heat-resistant resin.

Further, a surfactant, a leveling agent, an antistatic agent, etc. that are conventionally known may be contained as additives in the protective layer.

As a solvent used for a coating liquid for the protective layer, a device for dispersing the coating liquid, a method of applying the protective layer, a method of drying the protective layer, etc., those that are known and used for the recording layer may be used. In the case where an ultraviolet curable resin is used, it is applied and dried and a curing step with ultraviolet irradiation is required. An ultraviolet irradiation apparatus and irradiation conditions are as described above.

The thickness of the protective layer is preferably in the range of 0.1 μm to 100 μm, more preferably 0.5 μm to 50 μm.

<Oxygen-insulating Layer>

In the thermosensitive recording medium, prevention of entry of oxygen into the image recording layer and the light-heat conversion layer by providing an oxygen-insulating layer over the image recording layer and the light-heat conversion layer makes it possible to prevent an image from remaining instead of being erased, which is caused by optical degradation of the leuco dye in the image recording layer, and also to prevent decrease in absorption in the near-infrared region, which is caused by oxidation of the light-heat conversion material as a result of repeated heating to a high temperature.

The oxygen permeability of the oxygen-insulating layer at 25° C. and 80 RH % is 0.5 mL/($m^2$·24 hr·atm) or less, preferably 0.1 mL/($m^2$·24 hr·atm) or less, more preferably 0.05 mL/($m^2$·24 hr·atm) or less. When the oxygen permeability is greater than 0.5 mL/($m^2$·24 hr·atm), oxygen insulation is insufficient and light resistance is insufficient, thereby possibly rendering complete image erasure impossible.

Note that since it depends upon the temperature and humidity of the environment, the oxygen permeability is preferably low not only under a condition such as 25° C. and 80 RH % but also under a high-temperature and high-humidity condition such as 30° C. and 80 RH % or 35° C. and 80 RH %.

Here, the oxygen permeability is measured, for example, by a measuring method based upon JIS K7126B (equal pressure method) or ATSM D3985. Examples of usable measuring apparatuses include the oxygen permeability measuring apparatuses OX-TRAN 2/21 and OX-TRAN 2/61 (manufactured by MOCON, Inc.) and Model 8001 (manufactured by Systech Inc.).

As an oxygen-insulating material, polyvinyl alcohol, ethylene-polyvinyl alcohol copolymer or the like is generally used. However, because of being hydrophilic, these materials exhibit superior oxygen insulation at low humidity but absorb water and noticeably decrease in oxygen insulation as the humidity of their surroundings increases; thus, in cases where these materials are used outdoors in summer when the humidity is high, it may be impossible to secure sufficient oxygen insulation.

Examples of the oxygen-insulating layer for use in the present invention, whose oxygen permeability at 25° C. and 80 RH % is 0.5 mL/($m^2$·24 hr·atm) or less, include a vapor-deposited layer of an inorganic oxide, e.g., silica or alumina, and an inorganic vapor-deposited film obtained by vapor-depositing an inorganic oxide over a polymeric film of PET, nylon, etc., such as a silica vapor-deposited film, an alumina vapor-deposited film or a silica/alumina vapor-deposited film. Particularly preferable among these is a silica vapor-deposited film that is inexpensive, high in oxygen insulation and not much affected by temperature or humidity. Also, in view of vapor deposition suitability, oxygen insulation stability, heat resistance, etc., it is preferred that the base material for the inorganic vapor-deposited film be polyethylene terephthalate (PET).

The oxygen-insulating layer is provided over the surface of the image recording layer on the opposite side to the support, and further, the oxygen-insulating layer is preferably provided between the support and the image recording layer, and/or over the surface of the support on the opposite side to the image recording layer.

The oxygen-insulating layer can perform oxygen insulation even more effectively by being provided not only over the surface of the image recording layer on the opposite side to the support but also over the surface of the image recording layer on the support side, such that the image recording layer is sandwiched between the oxygen-insulating layers. The oxygen-insulating layer on the support side of the image recording layer can be provided between the support and the image recording layer, or over the surface of the support on the opposite side to the image recording layer.

Additionally, between the image recording layer and the oxygen-insulating layer situated over the surface of the image recording layer on the opposite side to the support, there may be other layers provided such as a light-heat conversion layer, an ultraviolet-absorbing layer, an intermediate layer, a protective layer, an adhesive layer and a sticky layer. This makes it possible to prevent entry of oxygen into the image recording layer more effectively and suppress photodecomposition of the leuco dye and oxidation of the light-heat conversion material.

Also, the oxygen-insulating layer on the support side of the image recording layer and the oxygen-insulating layer on the side of the image recording layer opposite to the support side may be identical or different.

The method for forming the oxygen-insulating layer is not particularly limited and the oxygen-insulating layer may be formed by a conventionally known method. Examples of the method include ordinary coating methods and lamination methods. In the case where only an inorganic vapor-deposited layer is formed as the oxygen-insulating layer, PVD, CVD or the like may be employed as a vapor deposition method.

Although the thickness of the oxygen-insulating layer varies depending upon the oxygen permeability, it is preferably in the range of 0.005 μm to 1,000 μm, more preferably 0.007 μm to 500 μm. When the thickness is greater than 1,000 μm, there may be a decrease in transparency and a decrease in recording sensitivity.

In the case where an inorganic vapor-deposited layer or an inorganic vapor-deposited film is used as the oxygen-insulating layer, the thickness of the inorganic vapor-deposited layer or the inorganic vapor-deposited film is preferably in the range of 5 nm to 100 nm, more preferably 7 nm to 80 nm. When the thickness is less than 5 nm, oxygen insulation may be imperfect. When the thickness is greater than 100 nm, there may be a decrease in transparency or there may be coloration.

An adhesive layer or a sticky layer may be provided between the oxygen-insulating layer and the layer placed under the oxygen-insulating layer. The method for forming the adhesive layer or the sticky layer is not particularly limited and may, for example, be an ordinary coating method or lamination method.

The thickness of the adhesive layer or the sticky layer is not particularly limited and may be suitably selected according to the intended purpose. The thickness is preferably in the range of 0.1 μm to 5 μm.

The material for the adhesive layer or the sticky layer is not particularly limited and may be suitably selected according to the intended purpose. Examples thereof include urea resins, melamine resins, phenol resins, epoxy resins, polyvinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic acid ester copolymers, methacrylic acid ester copolymers, natural rubber, cyanoacrylate resins and silicone resins.

The material for the adhesive layer or the sticky layer may be of hot-melt type.

In the present invention, by laying two or more inorganic vapor-deposited films, it is possible to enhance oxygen insulation further. In the case where inorganic vapor-deposited films are laid, they may be stuck together using the adhesive layer or the sticky layer.

<Underlayer>

In the present invention, to utilize applied heat effectively and increase sensitivity or to improve adhesion between the support and the image recording layer and prevent permeation of the materials of the image recording layer to the support, an underlayer may be provided between the image recording layer and the support.

The underlayer contains at least hollow particles, preferably contains a binder resin and may, if necessary, contain other components.

Examples of the hollow particles include single hollow particles each having one hollow portion inside, and multi-hollow particles each having multiple hollow portions inside. Note that one type of such hollow particles may be solely used or two or more types of such hollow particles may be used in combination.

The material for the hollow particles is not particularly limited and may be suitably selected according to the intended purpose. Suitable examples thereof include thermoplastic resins. The hollow particles may be a suitably produced product or may be a commercially available product. Examples of the commercially available product include MICROSPHERE R-300 (manufactured by Matsumoto Yushi-Seiyaku Co., Ltd.); ROPAQUE HP1055 and ROPAQUE HP433J (manufactured by ZEON CORPORATION); and SX866 (manufactured by JSR Corporation).

The amount of the hollow particles contained in the underlayer is not particularly limited and may be suitably selected according to the intended purpose. For example, the amount is preferably in the range of 10% by mass to 80% by mass relative to the amount of the underlayer.

As the binder resin, any resin similar to the one used for the image recording layer or the one used for the layer containing the polymer having an ultraviolet-absorbing structure may be used.

The underlayer may contain at least one selected from organic fillers, and inorganic fillers such as calcium carbonate, magnesium carbonate, titanium oxide, silicon oxide, aluminum hydroxide, kaolin and talc.

Additionally, the underlayer may further contain a lubricant, a surfactant, a dispersant, etc.

The thickness of the underlayer is not particularly limited and may be suitably selected according to the intended purpose. It is preferably in the range of 0.1 μm to 50 μm, more preferably 2 μm to 30 μm, even more preferably 12 μm to 24 μm.

<Back Layer>

In the present invention, in order to prevent static electricity and curling of the thermosensitive recording medium and improve conveyance capability thereof, a back layer may be provided on the side of the support opposite to the surface where the image recording layer is provided.

The back layer contains at least a binder resin and may, further, contain other components such as a filler, a conductive filler, a lubricant and a coloring pigment.

The binder resin is not particularly limited and may be suitably selected according to the intended purpose. For example, the binder resin is a thermosetting resin, an ultraviolet (UV) curable resin or an electron beam curable resin, particularly preferably an ultraviolet (UV) curable resin or a thermosetting resin.

As the ultraviolet curable resin, the thermosetting resin, the filler, the conductive filler and the lubricant, those similar to the ones usable for the image recording layer, the protective layer or the ultraviolet-absorbing layer can be suitably used.

<Adhesive Agent Layer or Sticky Agent Layer>

In the present invention, an image recording label can be obtained by providing an adhesive agent layer or a sticky agent layer over the surface of the support on the opposite side to the surface where the image recording layer is formed. As the material for the adhesive agent layer or the sticky agent layer, any material commonly used for an adhesive agent layer or a sticky agent layer can be used.

The material for the adhesive agent layer or the sticky agent layer is not particularly limited and may be suitably selected according to the intended purpose. Examples thereof include urea resins, melamine resins, phenol resins, epoxy resins, polyvinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic acid ester copolymers, methacrylic acid ester copolymers, natural rubber, cyanoacrylate resins and silicone resins.

The material for the adhesive agent layer or the sticky agent layer may be of hot-melt type. Also, release paper may or may not be used. By providing the adhesive agent layer or the sticky agent layer as just described, the image recording label can be affixed to the whole or part of the surface of a thick substrate such as a vinyl chloride card with a magnetic stripe, which is difficult to coat with the image recording layer. This makes it possible to improve the convenience of the medium; for example, part of information stored in a magnetic recorder can be displayed. The thermosensitive recording label provided with such an adhesive agent layer or sticky agent layer can also be used with a thick card such as an integrated circuit card or optical card.

In the thermosensitive recording medium, a colored layer may be provided between the support and the image recording layer, for the purpose of improving visibility. The colored layer can be formed by applying a solution or dispersion liquid, which contains a colorant and a resin binder, over a target surface and drying the solution or dispersion liquid; alternatively, the colored layer can be formed by simply sticking a colored sheet to the target surface.

The thermosensitive recording medium may also be provided with a color printing layer. Examples of colorants usable in the color printing layer include dyes and pigments contained in color inks used for conventional full-color printing. Examples of the resin binder include thermoplastic resins, thermosetting resins, ultraviolet curable resins and electron beam curable resins. The thickness of the color printing layer is suitably changed according to the printed color density and so may be selected in view of the desired printed color density.

In the thermoreversible recording medium, an irreversible recording layer may also be used. In the case where it is used, the respective recording layers may have the same or different tones of formed color. Additionally, a colored layer which has been printed with an intended pictorial design or the like by an ink-jet printer, a thermal transfer printer, a sublimation printer, etc. or by offset printing, gravure printing, etc. may be provided over the whole or part of the surface of the thermoreversible recording medium on the same surface side as the thermoreversible recording layer, or may be provided over part of the surface thereof on the opposite surface side. Further, an OP (overprint) varnish layer composed mainly of a curable resin may be provided over the whole or part of the colored layer. Examples of the intended pictorial design include letters/characters, patterns, diagrams, photographs, and information detected with an infrared ray. Also, any of the constituent layers may be simply colored by addition of dye or pigment.

Further, the thermosensitive recording medium of the present invention may also be provided with a hologram for security purposes. Also, to give design-related originality, the thermosensitive recording medium may be provided with a design such as a portrait, a company emblem or a symbol by forming depressions and protrusions in relief or in intaglio.

The thermosensitive recording medium can be formed into a desired shape according to its use, for example into a card, a tag, a label, a sheet or a roll. The thermosensitive recording medium formed into a card is used for a prepaid card, a discount card, a credit card, etc. The thermosensitive recording medium in the form of a tag which is smaller in size than the card can be used as a price tag, etc. The thermosensitive recording medium in the form of a tag which is larger in size than the card can be used as a ticket, a sheet for shipping instruction or process control, etc. The thermosensitive recording medium in the form of a label can be affixed and can therefore be formed into a variety of sizes and, for example, used for process control or product control, being affixed to a cart, a receptacle, a box, a container or the like which is repeatedly used. The thermoreversible recording medium in the form of a sheet which is larger in size than the card offers a wider area for recording and can therefore be used as a general document, an instruction sheet for process control, etc.

<Image-recording and Image-erasing Mechanism in Thermoreversible Recording Medium>

Next, an image-recording and image-erasing mechanism in the thermoreversible recording medium will be explained.

The image-recording and image-erasing mechanism includes an aspect in which transparency reversibly changes depending upon temperature, and an aspect in which color tone reversibly changes depending upon temperature.

In the aspect in which the transparency reversibly changes, the organic low-molecular-weight material in the thermoreversible recording medium is dispersed in particle form in the resin, and the transparency reversibly changes by heat between a transparent state and a white turbid state.

Visual confirmation of the transparency change is derived from the following phenomena. In the case of the transparent state (1), particles of the organic low-molecular-weight material dispersed in the resin base material are closely attached to the resin base material with no space in between, and there is no empty space present inside the particles; thus, light that has entered from one side permeates to the other side without scattering, and so the thermoreversible recording medium looks transparent. Meanwhile, in the case of the white turbid state (2), the particles of the organic low-molecular-weight material are formed of fine crystals of the organic low-molecular-weight material, and there are spaces (empty spaces) created at the interfaces between the crystals or at the interfaces between the particles and the resin base material; thus, light that has entered from the one side refracts at the interfaces between the empty spaces and the crystals or at the interfaces between the empty spaces and the resin and thereby scatters, and so the thermoreversible recording medium looks white.

Figure 3A:
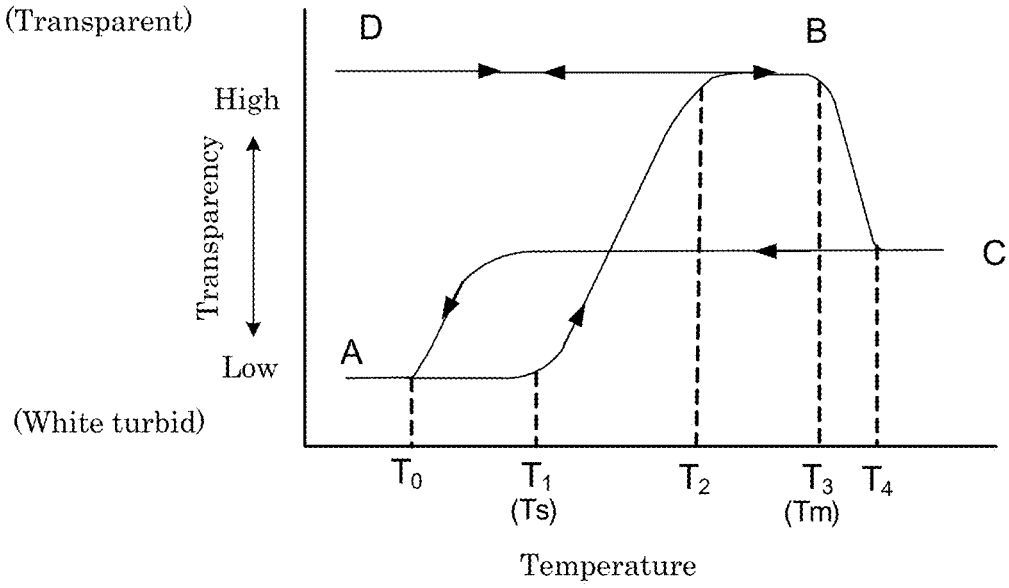
FIG. 3A is a graph showing a property regarding a transparent state and a white turbid state of a thermoreversible recording medium as a thermosensitive recording medium.

An example of the temperature-transparency change curve as regards a thermoreversible recording medium including a thermoreversible recording layer obtained by dispersing the organic low-molecular-weight material in the resin is shown in FIG. 3A.

The thermoreversible recording layer is in a white turbid opaque state (A), for example at normal temperature that is lower than or equal to the temperature $T_0$. Once the thermoreversible recording layer is heated, it gradually becomes transparent as the temperature exceeds the temperature $T_1$. When heated to a temperature between the temperatures $T_2$ and $T_3$, the thermoreversible recording layer becomes transparent (B), and remains transparent (D) even if, in this state, the temperature is brought back to normal temperature that is lower than or equal to $T_0$. This is attributable to the following: when the temperature is in the vicinity of $T_1$, the resin starts to soften, then the resin contracts as the softening proceeds, and empty spaces at the interfaces between the resin and the particles of the organic low-molecular-weight material or empty spaces inside the particles are reduced, so that the thermoreversible recording layer gradually becomes more and more transparent; at temperatures between $T_2$ and $T_3$, the organic low-molecular-weight material gets into a semi-melted state, and the thermoreversible recording layer becomes transparent as remaining empty spaces are filled with the organic low-molecular-weight material; when the thermoreversible recording layer is cooled with seed crystals remaining, crystallization takes place at a relatively high temperature; at this time, the resin is still in the softening state, so that the resin adapts to a volume change of the particles caused by the crystallization, which does not allow the empty spaces to form, and the transparent state is thus maintained.

When further heated to a temperature higher than or equal to the temperature $T_4$, the thermoreversible recording layer comes into a semitransparent state (C) that lies between the maximum transparency and the maximum opacity. Next, when the temperature is lowered, the thermoreversible recording layer returns to the initial white turbid opaque state (A), without getting into the transparent state again. It is inferred that this is because the organic low-molecular-weight material completely melts at a temperature higher than or equal to $T_4$, then gets into a supercooled state and crystallizes at a temperature slightly higher than $T_0$, and at this time the resin cannot adapt to a volume change of the particles caused by the crystallization, which leads to creation of empty spaces.

Here, in FIG. 3A, when the temperature of the thermoreversible recording layer is repeatedly raised to the temperature $T_5$ far higher than $T_4$, there may be caused such an erasure failure that an image cannot be erased even if the thermoreversible recording layer is heated to an erasure temperature.

This is attributed to a change in the internal structure of the thermoreversible recording layer caused by transfer of the organic low-molecular-weight material, which has melted by being heated, in the resin. To reduce degradation of the thermoreversible recording medium caused by repeated use, it is necessary to reduce the difference between $T_4$ and $T_5$ in FIG. 3A when the thermoreversible recording medium is heated; in the case where laser light is employed as a means of the heating, the intensity distribution of the laser light preferably has a form similar to that of a top hat rather than being a Gaussian distribution.

Regarding the temperature-transparency change curve shown in FIG. 3A, it should be noted that when the type of the resin, the organic low-molecular-weight material, etc. is changed, the transparency in the above-mentioned states may change depending upon the type.

Figure 3B:
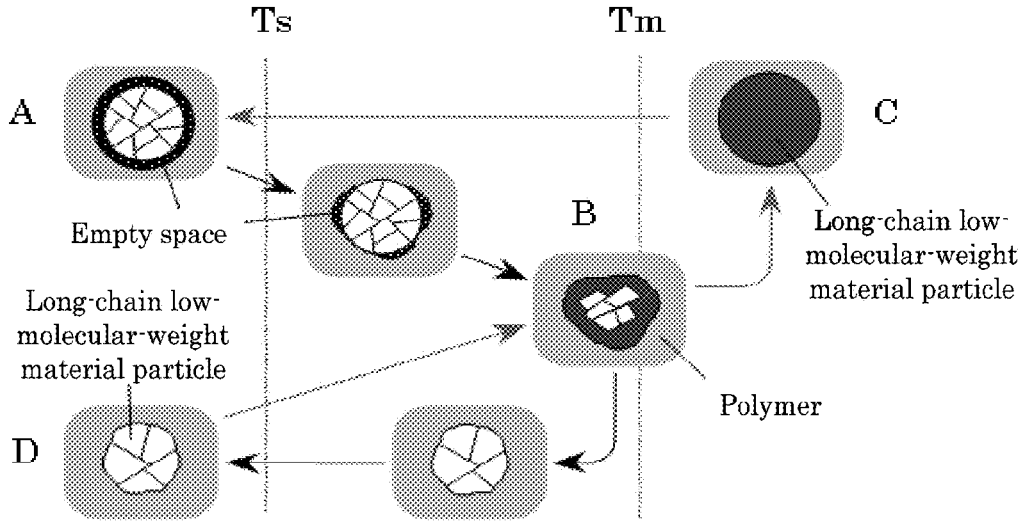
FIG. 3B is a schematic explanatory drawing showing a mechanism of change between a transparent state and a white turbid state of a thermoreversible recording medium as a thermosensitive recording medium.

FIG. 3B shows a mechanism of change in the transparency of the thermoreversible recording medium which reversibly changes by heat between a transparent state and a white turbid state.

In FIG. 3B, one long-chain low-molecular-weight material particle and a polymer around it are viewed, and changes related to creation and disappearance of an empty space, caused by heating and cooling, are shown. In a white turbid state (A), an empty space is created between the polymer and the low-molecular-weight material particle (or inside the particle), and thus a light scattering state is created. With heating to a temperature higher than the softening temperature (Ts) of the polymer, the empty space decreases in size and the transparency increases. With further heating to a temperature close to the melting temperature (Tm) of the low-molecular-weight material particle, part of the low-molecular-weight material particle melts; due to the volume expansion of the low-molecular-weight material particle that has melted, the empty space disappears as it is filled with the low-molecular-weight material particle, and a transparent state (B) is created. In this state, when cooling is carried out, the low-molecular-weight material particle crystallizes immediately below the melting temperature, there is no empty space created, and a transparent state (D) is maintained even at room temperature.

Subsequently, when heating is carried out such that the temperature becomes higher than or equal to the melting temperature of the low-molecular-weight material particle, there is created a difference in refractive index between the low-molecular-weight material particle that has melted and the polymer around it, and a semitransparent state (C) is created. In this state, when cooling is carried out to room temperature, the low-molecular-weight material particle is supercooled and crystallizes at a temperature lower than or equal to the softening temperature of the polymer; at this time, the polymer around the low-molecular-weight material particle is in a glassy state and therefore cannot adapt to a volume reduction of the low-molecular-weight material particle caused by its crystallization; thus, an empty space is created, and the white turbid state (A) is recreated.

Next, in the aspect in which color tone reversibly changes depending upon temperature, a leuco dye and a reversible developer are contained in a resin, and the color tone reversibly changes by heat between a transparent state and a color forming state.

Figure 4A:
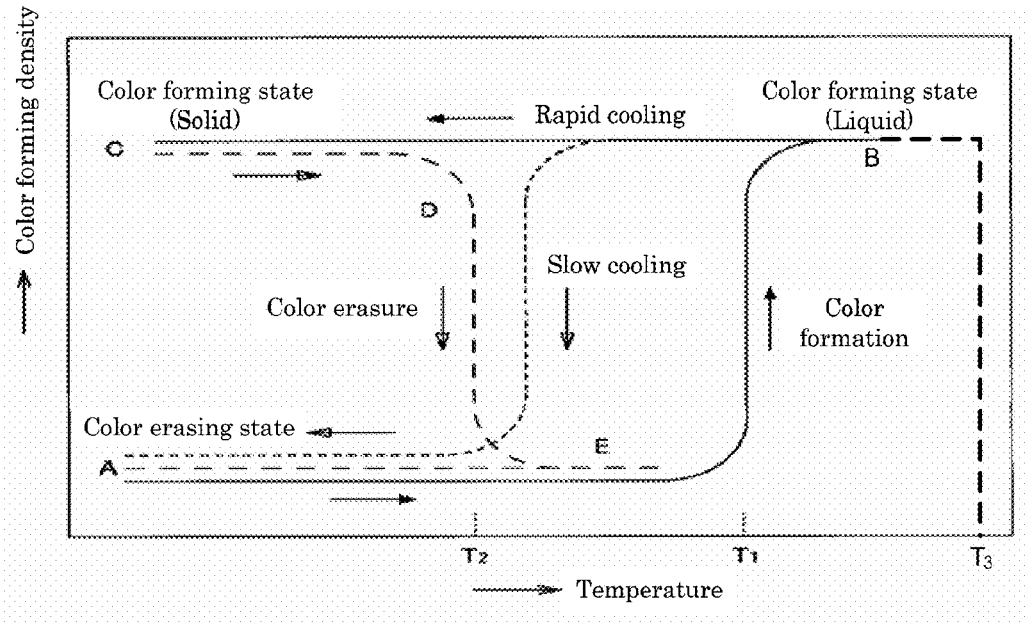
FIG. 4A is a graph showing a property regarding a color forming state and a color erasing state of a thermoreversible recording medium as a thermosensitive recording medium.
Figure 4B:
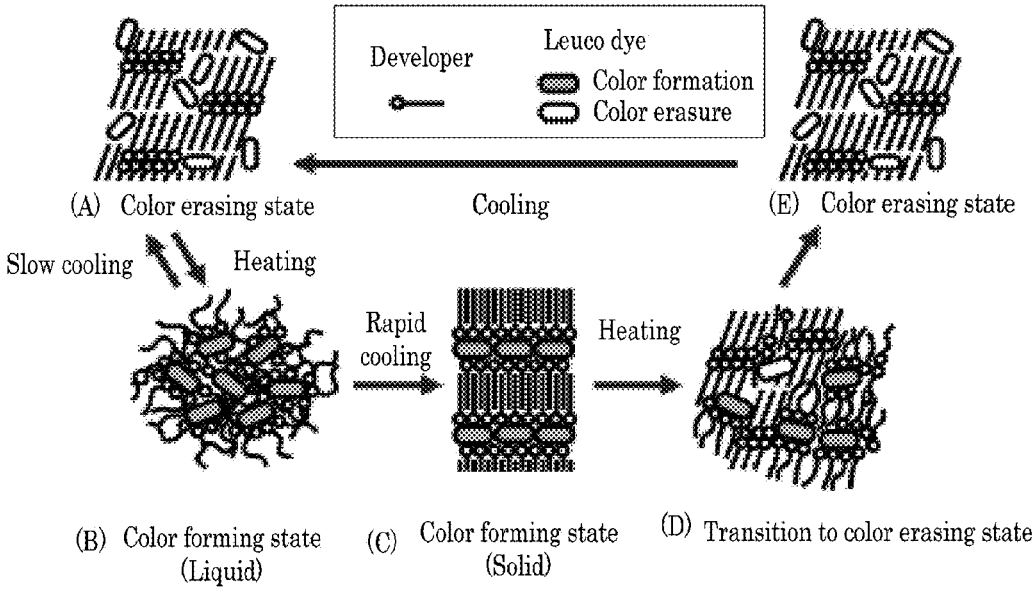
FIG. 4B is a schematic explanatory drawing showing a mechanism of change between a color forming state and a color erasing state of a thermoreversible recording medium as a thermosensitive recording medium.

FIG. 4A shows an example of a temperature-color forming density change curve regarding a thermoreversible recording medium including a thermoreversible recording layer in which the leuco dye and the reversible developer are contained in the resin. FIG. 4B shows a color-forming and color-erasing mechanism of the thermoreversible recording medium which reversibly changes by heat between a transparent state and a color forming state.

First of all, when the thermoreversible recording layer in a color erasing state (A) is increased in temperature, the leuco dye and the reversible developer melt and mix at the melting temperature $T_1$, which causes color formation to take place and brings the thermoreversible recording layer into a melted and color forming state (B). When the thermoreversible recording layer in the melted and color forming state (B) is rapidly cooled, the thermoreversible recording layer can be lowered in temperature to room temperature, with its color forming state kept, and thus the thermoreversible recording layer gets into a color forming state (C) where its color forming state is stabilized and fixed. Whether or not this color forming state is obtained depends upon the temperature decrease rate from the temperature in the melted state: in the case of slow cooling, the color is erased in the temperature decreasing process, and the thermoreversible recording layer gets into the color erasing state (A) it was in at the beginning, or gets into a state where the density is low in comparison with the density in the color forming state (C) produced by the rapid cooling. When the thermoreversible recording layer in the color forming state (C) is increased in temperature again, the color is erased at the temperature $T_2$ lower than the color forming temperature (from D to E), and when the thermoreversible recording layer in this state is lowered in temperature, it returns to the color erasing state (A) it was in at the beginning.

The color forming state (C) produced by rapidly cooling the thermoreversible recording layer in the melted state is a state where the leuco dye and the reversible developer are mixed together such that their molecules can undergo contact reaction, which is often a solid state. This state is a state where the melted mixture (color forming mixture) of the leuco dye and the reversible developer crystallizes and thereby maintains its color formation, and it is inferred that the color formation is stabilized by the formation of this structure. Meanwhile, the color erasing state is a state where the leuco dye and the reversible developer are phase-separated. It is inferred that this state is a state where molecules of at least one of the compounds gather to form a domain or are crystallized, and thus a state where the leuco dye and the reversible developer are separated from each other by the aggregation or the crystallization and stabilized. In many cases, as just described, completer color erasure is effected by phase separation of the leuco dye and the reversible developer and crystallization of the reversible developer.

Regarding both the color erasure by slow cooling from the melted state and the color erasure by temperature increase from the color forming state, shown in FIG. 4A, the aggregated structure changes at $T_2$, causing phase separation and crystallization of the reversible developer.

Further, in FIG. 4A, when the thermoreversible recording layer is repeatedly increased in temperature to the temperature $T_3$ higher than or equal to the melting temperature $T_1$, an erasure failure may arise in which an image cannot be erased even if the thermoreversible recording layer is heated to an erasure temperature. It is inferred that this is because the reversible developer thermally decomposes and thus hardly aggregates or crystallizes, which makes it difficult for the reversible developer to separate from the leuco dye. Degradation of the thermoreversible recording medium caused by repeated use can be suppressed by reducing the difference between the melting temperature $T_1$ and the temperature $T_3$ in FIG. 4A when the thermoreversible recording medium is heated.

(Image Recording Method)

An image recording method of the present invention includes applying light to the thermosensitive recording medium of the present invention so as to record an image on the thermosensitive recording medium.

Regarding the thermosensitive recording medium, both of the following aspects are favorable: an aspect in which the thermosensitive recording medium includes a thermosensitive recording layer as an image recording layer and performs image recording once, and an aspect in which the thermosensitive recording medium includes a thermoreversible recording layer as an image recording layer and repeatedly performs image recording and image erasure.

As the light, laser light is preferably used.

(Image Processing Method)

An image processing method of the present invention includes applying light to the thermosensitive recording medium of the present invention so as to carry out at least one of image recording and image erasure on the thermosensitive recording medium.

As the thermosensitive recording medium, a thermoreversible recording medium including a thermoreversible recording layer as an image recording layer is used.

The image processing method of the present invention includes at least one of an image recording step and an image erasing step and may, if necessary, include suitably selected other steps.

The image processing method of the present invention includes all of the following aspects: an aspect in which both recording and erasure of an image are carried out, an aspect in which only recording of an image is carried out, and an aspect in which only erasure of an image is carried out.

<Image Recording Step and Image Erasing Step>

The image recording step in the image processing method of the present invention is a step of recording an image on the thermoreversible recording medium by heating the thermoreversible recording medium. Examples of methods of heating the thermoreversible recording medium include conventionally known heating methods. When a product distribution line is supposed, a method of irradiating the thermoreversible recording medium with laser light to heat the medium is particularly preferable because an image can be formed on the medium in a noncontact manner.

The image erasing step in the image processing method of the present invention is a step of heating the thermoreversible recording medium so as to erase an image recorded on the thermoreversible recording medium. As a heat source, laser light or other heat source may be used. In the case where the thermoreversible recording medium is heated by laser light irradiation, it takes a lot of time to scan one laser beam and irradiate the whole of a predetermined area with the laser beam; accordingly, if the image is to be erased in a short period of time, it is preferable to erase it by heating the thermoreversible recording medium with the use of an infrared lamp, a heat roller, a hot stamp, a dryer, etc. among heat sources. Also, in the case where the thermoreversible recording medium is attached to a foamed polystyrene box serving as a transport container used in a product distribution line, the foamed polystyrene box itself will melt if heated, and thus it is preferable to erase an image by applying laser light so as to locally heat the thermoreversible recording medium only.

By applying the laser light so as to heat the thermoreversible recording medium, it is possible to record an image on the thermoreversible recording medium in a noncontact manner.

In the image processing method of the present invention, in general, an image is changed (subjected to the above-mentioned image erasing step) when the thermoreversible recording medium is reused, then an image is recorded on the thermoreversible recording medium by the image recording step; it should, however, be noted that recording and erasure of an image do not necessarily have to follow this order, and an image may be erased by the image erasing step after recorded by the image recording step.

The laser light is not particularly limited and may be suitably selected according to the intended purpose. Examples thereof include light of commonly used lasers such as a YAG laser, a fiber laser and a laser diode (LD). When a product distribution line is supposed, light of a laser diode is particularly preferable because the apparatus can be reduced in size, and further, costs can be reduced.

The output of the laser light applied in the image recording step is not particularly limited and may be suitably selected according to the intended purpose; nevertheless, the output is preferably 1 W or greater, more preferably 3 W or greater, even more preferably 5 W or greater. When the output of the laser light is less than 1 W, image formation takes a lot of time, and if an attempt is made to shorten the image formation time, it may be impossible to obtain a high-density image because of lack of output. The upper limit of the output of the laser light is not particularly limited and may be suitably selected according to the intended purpose; nevertheless, the upper limit is preferably 200 W or less, more preferably 150 W or less, even more preferably 100 W or less. When the output of the laser light is greater than 200 W, the laser apparatus may have to be enlarged.

The scanning speed of the laser light applied in the image recording step is not particularly limited and may be suitably selected according to the intended purpose; nevertheless, the scanning speed is preferably 300 mm/s or higher, more preferably 500 mm/s or higher, even more preferably 700 mm/s or higher. When the scanning speed is lower than 300 mm/s, image recording takes a lot of time. The upper limit of the scanning speed of the laser light is not particularly limited and may be suitably selected according to the intended purpose; nevertheless, the upper limit is preferably 15,000 mm/s or lower, more preferably 10,000 mm/s or lower, even more preferably 8,000 mm/s or lower. When the scanning speed is higher than 15,000 mm/s, it is difficult to form a uniform image.

The spot diameter of the laser light applied in the image recording step is not particularly limited and may be suitably selected according to the intended purpose; nevertheless, the spot diameter is preferably 0.02 mm or greater, more preferably 0.1 mm or greater, even more preferably 0.15 mm or greater. The upper limit of the spot diameter of the laser light is not particularly limited and may be suitably selected according to the intended purpose; nevertheless, the upper limit is preferably 3.0 mm or less, more preferably 2.5 mm or less, even more preferably 2.0 mm or less. When the spot diameter is small, the line width of an image is small, and the contrast of the image is low, thereby causing a decrease in visibility. When the spot diameter is large, the line width of an image is large, and adjacent lines may overlap, thereby making it difficult to perform image recording involving small letters/characters.

The output of the laser light applied in the image erasing step, in which the thermoreversible recording medium is heated by laser light irradiation so as to erase an image recorded on the thermoreversible recording medium, is not particularly limited and may be suitably selected according to the intended purpose; nevertheless, the output is preferably 5 W or greater, more preferably 7 W or greater, even more preferably 10 W or greater. When the output of the laser light is less than 5 W, image erasure takes a lot of time, and if an attempt is made to shorten the image erasure time, there may be a failure in image erasure because of lack of output. The upper limit of the output of the laser light is not particularly limited and may be suitably selected according to the intended purpose; nevertheless, the upper limit is preferably 200 W or less, more preferably 150 W or less, even more preferably 100 W or less. When the output of the laser light is greater than 200 W, the laser apparatus may have to be enlarged.

The scanning speed of the laser light applied in the image erasing step, in which the thermoreversible recording medium is heated by laser light irradiation so as to erase an image recorded on the thermoreversible recording medium, is not particularly limited and may be suitably selected according to the intended purpose; nevertheless, the scanning speed is preferably 100 mm/s or higher, more preferably 200 mm/s or higher, even more preferably 300 mm/s or higher. When the scanning speed is lower than 100 mm/s, image erasure takes a lot of time. The upper limit of the scanning speed of the laser light is not particularly limited and may be suitably selected according to the intended purpose; nevertheless, the upper limit is preferably 20,000 mm/s or lower, more preferably 15,000 mm/s or lower, even more preferably 10,000 mm/s or lower. When the scanning speed is higher than 20,000 mm/s, it may be difficult to perform uniform image erasure.

The spot diameter of the laser light applied in the image erasing step, in which the thermoreversible recording medium is heated by laser light irradiation so as to erase an image recorded on the thermoreversible recording medium, is not particularly limited and may be suitably selected according to the intended purpose; nevertheless, the spot diameter is preferably 0.5 mm or greater, more preferably 1.0 mm or greater, even more preferably 2.0 mm or greater.

The upper limit of the spot diameter of the laser light is not particularly limited and may be suitably selected according to the intended purpose; nevertheless, the upper limit is preferably 14.0 mm or less, more preferably 10.0 mm or less, even more preferably 7.0 mm or less.

When the spot diameter is small, image erasure takes a lot of time. When the spot diameter is large, there may be a failure in image erasure because of lack of output.

<Image Processing Apparatus>

An image processing apparatus for use in the present invention includes at least a laser light applying unit and may, if necessary, include suitably selected other units.

—Laser Light Emitting Unit—

As a laser light emitting unit in the image recording step and/or the image erasing step, anything is acceptable as long as it employs laser light having a maximum wavelength in the vicinity of the maximum absorption peak of the light-heat conversion material contained in the thermoreversible recording medium, and the laser light emitting unit may be suitably selected according to the intended purpose. Examples thereof include, but are not limited to, a YAG laser, a fiber laser and a laser diode (LD). Here, the laser light has a single wavelength.

The wavelength of the laser light emitted from any of the YAG laser, the fiber laser and the laser diode ranges between the visible region and the near-infrared region (between several hundred micrometers and approximately 2 μm), and the short wavelength yields an advantage in that a high-definition image can be formed. Also, the YAG laser and the fiber laser have high output and are therefore advantageous in that the image processing speed can be increased. The laser diode has a small laser and is therefore advantageous in that the apparatus can be reduced in size, and further, costs can be lowered. Thus, when a product distribution line is supposed, use of light of a laser diode is particularly preferable.

The wavelength of the laser light emitted from the laser light emitting unit may be suitably selected according to the intended purpose and is preferably in the range of 700 nm to 2,000 nm, more preferably 780 nm to 1,600 nm, where the resins contained in the thermoreversible recording medium have low absorption. When the wavelength is lower than 700 nm, there is a problem in that the thermoreversible recording medium easily degrades by the laser light irradiation. When the wavelength is higher than 2,000 nm, the laser light is absorbed by the resins contained in the thermoreversible recording medium, and thus there is a problem in that a high-output laser diode is required and so the apparatus is enlarged.

The fundamental structure of the image processing apparatus is similar to that of a so-called "laser marker" except that the image processing apparatus includes at least the laser light emitting unit. The image processing apparatus also includes at least an oscillator unit, a power control unit and a program unit.

Figure 5:
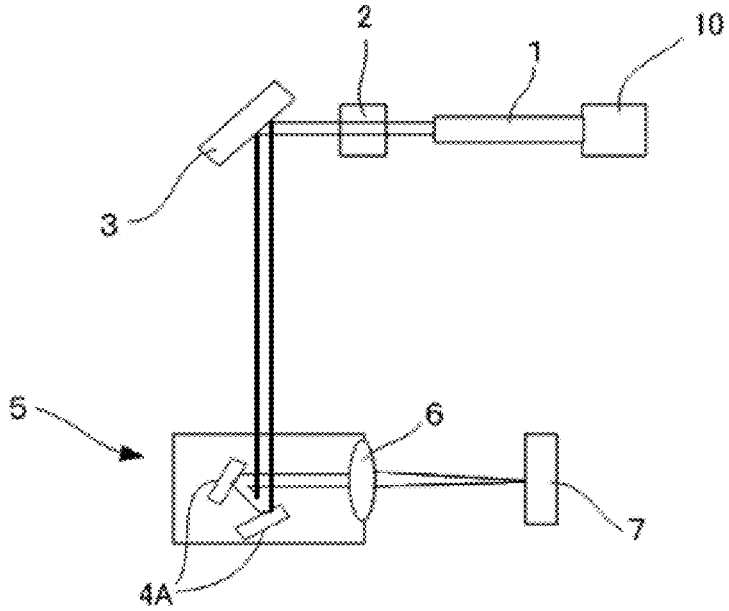
FIG. 5 is a drawing for explaining an example of an image processing apparatus for use in an image processing method of the present invention.

Here, a laser irradiation unit is mainly shown in FIG. 5 in relation to an example of an image processing apparatus for use in the present invention. The image processing apparatus shown in FIG. 5 employs as a laser light source a fiber coupled laser diode (LIMO25-F100-DL808-EX362) manufactured by LIMO, whose oscillation wavelength is 808 nm, fiber diameter is 100 μm and maximum output is 25 W. Laser light is emitted from a fiber, and the emitted laser light is converted to parallel light by a collimator immediately after its emission; a mask or a aspheric lens may be installed as a light irradiation intensity distribution adjusting unit in a parallel light path and adjustment may be made such that the light intensity distribution changes in vertical cross section with respect to the advancing direction of the laser light.

The oscillator unit includes a laser oscillator 1, a beam expander 2, a scanning unit 5 and so forth.

The scanning unit 5 includes a galvanometer (not shown), and mirrors 4A attached to this galvanometer. Laser light that has been output from the laser oscillator 1 is rotationally scanned at high speed with the two mirrors 4A for the X-axis direction and the Y-axis direction; by doing so, image formation or erasure is carried out on a thermoreversible recording medium 7.

The power control unit includes a drive power source for a light source that energizes a laser medium; a drive power source for the galvanometer; a power source for cooling a Peltier device, etc.; a control unit for controlling the overall image processing apparatus; and so forth.

Upon touchpanel input or keyboard input, the program unit is configured to input conditions such as the intensity of the laser light and the speed of the laser scanning and to produce and edit letters/characters, etc. to be recorded, for the purpose of recording or erasing an image.

The laser irradiation unit, namely an image recording/erasure head portion, is installed in the image processing apparatus which also includes a conveyance portion of the thermoreversible recording medium, a control unit thereof, a monitor unit (touchpanel) and so forth.

The image processing method of the present invention is capable of repeatedly recording and erasing an image at high speed and in a noncontact manner onto and from a thermoreversible recording medium, for example a label affixed to cardboard or to a container such as a plastic container, and employs a thermoreversible recording medium which prevents coloration of the background and decrease in image density even when exposed to light over a long period of time and which has sufficient erasing capability; therefore, the image processing method can be suitably used especially in product distribution and delivery systems. In this case, for example, it is possible to form and erase an image on and from the label while moving the cardboard or the plastic container placed on a conveyor belt, and to shorten the shipping time because the line does not need stopping. Also, the cardboard or the plastic container with the label affixed thereto can be reused as it is, without the need to detach the label, and can be subjected to image erasure and image formation again.

EXAMPLES

The following explains Examples of the present invention. It should, however, be noted that the scope of the present invention is not confined to these Examples.

In each of the following Examples and Comparative Examples, a thermoreversible recording medium was produced as a suitable example of a thermosensitive recording medium and evaluated. A case where image recording was carried out only once using a thermoreversible recording medium, without repeating image recording and image erasure, is relevant to an Example where a thermosensitive recording medium was evaluated.

The oxygen permeability in the following Examples and Comparative Examples was measured at 25° C. and 80 RH % using an oxygen permeability measuring apparatus (OX-TRAN 100, manufactured by MOCON, Inc.).

Example 1

<Production of Thermoreversible Recording Medium>

A thermoreversible recording medium whose color tone reversibly changed by heat between a transparent state and a color forming state was produced as follows.

—Support—

As a support, a white polyester film having a thickness of 125 μm (TETORON FILM U2L98W, manufactured by Teijin DuPont Films Japan Limited) was used.

—Underlayer—

An underlayer coating liquid was prepared by pouring 30 parts by mass of a styrene-butadiene copolymer (PA-9159, manufactured by Nippon A&L Inc.), 12 parts by mass of a polyvinyl alcohol resin (POVAL PVA103, manufactured by Kuraray Co., Ltd.), 20 parts by mass of hollow particles (MICROSPHERE R-300, manufactured by Matsumoto Yushi-Seiyaku Co., Ltd.) and 40 parts by mass of water, and stirring the ingredients for approximately 1 hour such that the mixture became uniform.

Next, the obtained underlayer coating liquid was applied onto the support using a wire bar, then heated and dried at 80° C. for 2 minutes, and an underlayer having a thickness of 20 μm was thus formed.

—Thermoreversible Recording Layer—

Using a ball mill, 5 parts by mass of the reversible developer represented by Structural Formula (1) below, 1 part by mass of the color erasure accelerator represented by Structural Formula (2) below, 10 parts by mass of an acrylic polyol 50% by mass solution (hydroxyl value: 200 mgKOH/g) and 80 parts by mass of methyl ethyl ketone were pulverized and dispersed so as to have an average particle diameter of approximately 1 μm.

[Reversible Developer]

<Structural Formula (1)>

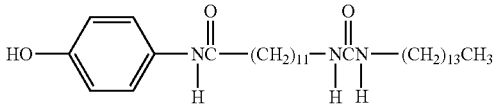

[Color Erasure Accelerator]

<Structural Formula (2)>

$C_{17}H_{35}CONHC_{18}H_{37}$

Next, 1 part by mass of 2-anilino-3-methyl-6-diethylaminofluoran as a leuco dye, 1.2 parts by mass of an $LaB_6$ 1.85% by mass dispersion solution (KHF-7A, manufactured by SUMITOMO METAL MINING CO., LTD.) and 5 parts by mass of an isocyanate (CORONATE HL, manufactured by Nippon Polyurethane Industry Co., Ltd.) were added to the obtained dispersion liquid in which the reversible developer had been pulverized and dispersed, then the mixture was sufficiently stirred, and a coating liquid for a thermoreversible recording layer was thus prepared.

Next, the obtained coating liquid for a thermoreversible recording layer was applied, using a wire bar, over the support with the underlayer already formed thereon, then the coating liquid was heated and dried at 100° C. for 2 minutes and subsequently cured at 60° C. for 24 hours, and a thermoreversible recording layer having a thickness of 10 μm was thus formed.

—Ultraviolet-absorbing Layer—

Ten parts by mass of an ultraviolet-absorbing polymer 40% by mass solution (UV-G302, manufactured by NIPPON SHOKUBAI CO., LTD.), 1.0 part by mass of an isocyanate (CORONATE HL, manufactured by Nippon Polyurethane Industry Co., Ltd.) and 12 parts by mass of methyl ethyl ketone were poured and sufficiently stirred, and a coating liquid for an ultraviolet-absorbing layer was thus prepared.

Next, the coating liquid for an ultraviolet-absorbing layer was applied over the thermoreversible recording layer using a wire bar, then heated and dried at 90° C. for 1 minute and subsequently heated at 60° C. for 24 hours, and an ultraviolet-absorbing layer having a thickness of 10 μm was thus formed.

—Oxygen-Insulating Layer—

Five parts by mass of a urethane-based adhesive (TM-567, manufactured by Toyo-Morton, Ltd.), 0.5 parts by mass of an isocyanate (CAT-RT-37, manufactured by Toyo-Morton, Ltd.) and 5 parts by mass of ethyl acetate were poured and sufficiently stirred to prepare a coating liquid for an adhesive layer.

Next, the coating liquid for an adhesive layer was applied over a silica vapor-deposited PET film (IB-PET-C, manufactured by Dai Nippon Printing Co., Ltd., oxygen permeability: 15 mL/($m^2$·day·MPa)) using a wire bar, then heated and dried at 80° C. for 1 minute. Thereafter, the obtained product was affixed onto the ultraviolet-absorbing layer and then heated at 50° C. for 24 hours, and an oxygen-insulating layer having a thickness 12 μm was thus formed.

—Back Layer—

Seven-point-five parts by mass of pentaerythritol hexaacrylate (KAYARAD DPHA, manufactured by Nippon Kayaku Co., Ltd.), 2.5 parts by mass of an urethane acrylate oligomer (ART RESIN UN-3320HA, manufactured by Negami Chemical Industrial Co., Ltd.), 0.5 parts by mass of a photopolymerization initiator (IRGACURE 184, manufactured by Nihon Ciba-Geigy K.K.) and 13 parts by mass of isopropyl alcohol were poured and sufficiently stirred using a ball mill to prepare a coating liquid for a back layer.

Next, the coating liquid for a back layer was applied, using a wire bar, over the surface of the support on the side where the thermoreversible recording layer was not formed, then the coating liquid was heated and dried at 90° C. for 1 minute and subsequently cross-linked by means of an ultraviolet lamp of 80 W/cm, and a back layer having a thickness of 4 μm was thus formed. In this manner, a thermoreversible recording medium of Example 1 was produced.

Regarding the thermoreversible recording medium of Example 1, the ratio (Y/X) was 2.7, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm, with the absorption intensities being measured with a spectrophotometer (U-4100, manufactured by Hitachi High-Technologies Corporation).

Example 2

—Production of Thermoreversible Recording Medium—

A thermoreversible recording medium of Example 2 was produced in the same manner as in Example 1, except that 2.8 parts by mass of a cesium-containing tungsten oxide 10% by mass dispersion solution (YMF-01, manufactured by SUMITOMO METAL MINING CO., LTD.) was used as a light-heat conversion material instead of 1.2 parts by mass of the $LaB_6$ 1.85% by mass dispersion solution (KHF-7A, manufactured by SUMITOMO METAL MINING CO., LTD.).

Regarding the thermoreversible recording medium of Example 2, the ratio (Y/X) was 2.8, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm, with the absorption intensities being measured with a spectrophotometer (U-4100, manufactured by Hitachi High-Technologies Corporation).

Example 3

—Production of Thermoreversible Recording Medium—

A thermoreversible recording medium of Example 3 was produced in the same manner as in Example 1, except that 15 parts by mass of an ATO 30% by mass dispersion solution (SN-100P, manufactured by ISHIHARA SANGYO KAISHA, LTD.) was used as a light-heat conversion material instead of 1.2 parts by mass of the $LaB_6$ 1.85% by mass dispersion solution (KHF-7A, manufactured by SUMITOMO METAL MINING CO., LTD.).

Regarding the thermoreversible recording medium of Example 3, the ratio (Y/X) was 3.1, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm, with the absorption intensities being measured with a spectrophotometer (U-4100, manufactured by Hitachi High-Technologies Corporation).

Example 4

—Production of Thermoreversible Recording Medium—

A thermoreversible recording medium of Example 4 was produced in the same manner as in Example 1, except that 15 parts by mass of an ITO 20% by mass dispersion solution (Mitsubishi Materials Corporation) was used as a light-heat conversion material instead of 1.2 parts by mass of the $LaB_6$ 1.85% by mass dispersion solution (KHF-7A, manufactured by SUMITOMO METAL MINING CO., LTD.).

Regarding the thermoreversible recording medium of Example 4, the ratio (Y/X) was 8.3, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm, with the absorption intensities being measured with a spectrophotometer (U-4100, manufactured by Hitachi High-Technologies Corporation).

Example 5

—Production of Thermoreversible Recording Medium—

A thermoreversible recording medium of Example 5 was produced in the same manner as in Example 1, except that 25 parts by mass of a zinc antimonate 20% by mass dispersion solution (CELNAX CX-Z2101P, manufactured by Nissan Chemical Industries, Ltd.) was used as a light-heat conversion material instead of 1.2 parts by mass of the $LaB_6$ 1.85% by mass dispersion solution (KHF-7A, manufactured by SUMITOMO METAL MINING CO., LTD.).

Regarding the thermoreversible recording medium of Example 5, the ratio (Y/X) was 3.6, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm, with the absorption intensities being measured with a spectrophotometer (U-4100, manufactured by Hitachi High-Technologies Corporation).

Example 6

<Production of Thermoreversible Recording Medium>

A thermoreversible recording layer was formed in the same manner as in Example 1, except that 1.2 parts by mass of the $LaB_6$ 1.85% by mass dispersion solution (KHF-7A, manufactured by SUMITOMO METAL MINING CO., LTD.) was removed.

Next, the after-mentioned coating liquid for a light-heat conversion layer was applied over the thermoreversible recording layer using a wire bar, then heated and dried at 90° C. for 1 minute and subsequently heated at 60° C. for 2 hours, and a light-heat conversion layer having a thickness of 3 μm was thus formed.

—Preparation of Coating Liquid for Light-heat Conversion Layer—

Six parts by mass of an acrylic polyol resin 50% by mass solution (LR327, manufactured by MITSUBISHI RAYON CO., LTD.), 2 parts by mass of an $LaB_6$ 1.85% by mass dispersion solution (KHF-7A, manufactured by SUMITOMO METAL MINING CO., LTD.), 2.4 parts by mass of an isocyanate (CORONATE HL, manufactured by Nippon Polyurethane Industry Co., Ltd.) and 14 parts by mass of methyl ethyl ketone were poured and sufficiently stirred to prepare a coating liquid for a light-heat conversion layer.

Subsequently, the ultraviolet-absorbing layer and the oxygen-insulating layer of Example 1 were formed as in Example 1, and a thermoreversible recording medium of Example 6 was thus produced.

Example 7

—Production of Thermoreversible Recording Medium—

A thermoreversible recording medium of Example 7 was produced in the same manner as in Example 6, except that 4.6 parts by mass of a cesium-containing tungsten oxide 10% by mass dispersion solution (YMF-01, manufactured by SUMITOMO METAL MINING CO., LTD.) was used instead of 2 parts by mass of the $LaB_6$ 1.85% by mass dispersion solution (KHF-7A, manufactured by SUMITOMO METAL MINING CO., LTD.).

Example 8

—Production of Thermoreversible Recording Medium—

A thermoreversible recording medium of Example 8 was produced in the same manner as in Example 1, except that a white polyester film (TETORON FILM U2L98W, manufactured by Teijin DuPont Films Japan Limited) having a thickness of 125 μm, with the oxygen-insulating layer of Example 1 provided thereon, was used as a support instead of only using the white polyester film (TETORON FILM U2L98W, manufactured by Teijin DuPont Films Japan Limited) having a thickness of 125 μm.

Example 9

—Production of Thermoreversible Recording Medium—

A thermoreversible recording medium of Example 9 was produced in the same manner as in Example 1, except that 0.6 parts by mass of an $LaB_6$ 1.85% by mass dispersion solution (KHF-7A, manufactured by SUMITOMO METAL MINING CO., LTD.) and 7 parts by mass of an ITO 20% by mass dispersion solution (Mitsubishi Materials Corporation) were used as a light-heat conversion material instead of 1.2 parts by mass of the $LaB_6$ 1.85% by mass dispersion solution (KHF-7A, manufactured by SUMITOMO METAL MINING CO., LTD.).

Comparative Example 1

—Production of Thermoreversible Recording Medium—

A thermoreversible recording medium of Comparative Example 1 was produced in the same manner as in Example 1, except that 1.2 parts by mass of the $LaB_6$ 1.85% by mass dispersion solution (KHF-7A, manufactured by SUMITOMO METAL MINING CO., LTD.) was removed from the thermoreversible recording layer and that 0.5 parts by mass of a phthalocyanine-based light-heat conversion material (YKR-3070, manufactured by Yamamoto Chemicals, Inc.; maximum absorption peak: 810 nm) 5% by mass solution was added.

Comparative Example 2

—Production of Thermoreversible Recording Medium—

A thermoreversible recording medium of Comparative Example 2 was produced in the same manner as in Example 6, except that 2 parts by mass of the $LaB_6$ 1.85% by mass dispersion solution (KHF-7A, manufactured by SUMITOMO METAL MINING CO., LTD.) was removed from the light-heat conversion layer and that 1.5 parts by mass of a phthalocyanine-based light-heat conversion material (YKR-3070, manufactured by Yamamoto Chemicals, Inc.; maximum absorption peak: 810 nm) 5% by mass solution was added.

Comparative Example 3

—Production of Thermoreversible Recording Medium—

An ATO layer as a light-heat conversion layer was formed on the support of Example 1 by vacuum vapor deposition so as to have a thickness of 950 μm. The thermoreversible recording layer of Example 6 was formed on this light-heat conversion layer as in Example 6, then the ultraviolet-absorbing layer and the oxygen-insulating layer of Example 1 were formed as in Example 1, and a thermoreversible recording medium of Comparative Example 3 was thus produced.

Example 10

<Production of Thermosensitive Recording Medium>

A thermosensitive recording medium whose color tone irreversibly changed by heat from a transparent state to a color forming state was produced as follows.

—Thermosensitive Recording Layer—

Using a ball mill, 6 parts by mass of octadecylphosphonic acid as a developer, 16 parts by mass of a polyvinyl acetoacetal 10% by mass solution (KS-1, manufactured by SEKISUI CHEMICAL CO., LTD.), 12 parts by mass of toluene and 3 parts by mass of methyl ethyl ketone were pulverized and dispersed so as to have an average particle diameter of approximately 0.3 μm.

Next, 1.5 parts by mass of 2-anilino-3-methyl-6-diethylaminofluoran as a leuco dye, and 1.8 parts by mass of an $LaB_6$ 1.85% by mass dispersion solution (KHF-7A, manufactured by SUMITOMO METAL MINING CO., LTD.) as a light-heat conversion material were added to the obtained dispersion liquid and sufficiently stirred to prepare a coating liquid for a thermosensitive recording layer.

Next, the obtained coating liquid for a thermosensitive recording layer was applied over the support of Example 1 using a wire bar, then heated and dried at 60° C. for 2 minutes, and a thermosensitive recording layer having a thickness of 10 μm was thus formed.

—Protective Layer—

Using a ball mill, 3 parts by mass of silica (P-832, manufactured by MIZUSAWA INDUSTRIAL CHEMICALS, LTD.), 3 parts by mass of a polyvinyl acetoacetal 10% by mass solution (KS-1, manufactured by SEKISUI CHEMICAL CO., LTD.) and 14 parts by mass of methyl ethyl ketone were pulverized and dispersed so as to have an average particle diameter of 0.3 μm.

Next, 12 parts by mass of a silicone-modified polyvinyl butyral 12.5% by mass solution (SP-712, manufactured by Dainichiseika Color & Chemicals Mfg. Co., Ltd.) and 24 parts by mass of methyl ethyl ketone were added to the obtained dispersion liquid and sufficiently stirred to prepare a coating liquid for a protective layer.

Subsequently, the coating liquid was applied over the thermosensitive recording layer using a wire bar, then heated and dried at 60° C. for 2 minutes, and a protective layer having a thickness of 1 μm was thus formed. In this manner, a thermosensitive recording medium of Example 10 was produced.

Comparative Example 4

A thermosensitive recording medium of Comparative Example 4 was produced in the same manner as in Example 10, except that 1.8 parts by mass of the $LaB_6$ 1.85% by mass dispersion solution (KHF-7A, manufactured by SUMITOMO METAL MINING CO., LTD.) as a light-heat conversion material was removed from the coating liquid for a thermosensitive recording layer and that 3.6 parts by mass of a phthalocyanine-based light-heat conversion material (YKR-3070, manufactured by Yamamoto Chemicals, Inc., maximum absorption peak: 810 nm) 5% by mass solution was added.

Example 11

<Production of Thermoreversible Recording Medium>

A thermoreversible recording medium whose transparency reversibly changed by heat between a transparent state and a white turbid state was produced as follows.

—Support—

As a support, a transparent PET film (LUMIRROR188-T60, manufactured by Toray Industries, Inc.) having a thickness of 188 μm was used.

—Thermoreversible Recording Layer—

Three parts by mass of the organic low-molecular-weight material represented by Structural Formula (3) below and 7 parts by mass of docosyl behenate were added into a resin solution obtained by dissolving 26 parts by mass of a vinyl chloride copolymer (MR 110, manufactured by ZEON CORPORATION) in 210 parts by mass of methyl ethyl ketone; then, in a glass jar, ceramic beads having a diameter of 2 mm each were placed, and the mixture was dispersed for 48 hours using PAINT SHAKER (manufactured by Asada Iron Works. Co., Ltd), and a uniform dispersion liquid was thus prepared.

<Structural Formula (3)>

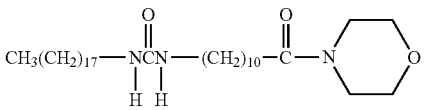

Next, 1.2 parts by mass of an $LaB_6$ 1.85% by mass dispersion solution (KHF-7A, manufactured by SUMITOMO METAL MINING CO., LTD.) as a light-heat conversion material and 4 parts by mass of an isocyanate compound (CORONATE 2298-90T, manufactured by Nippon Polyurethane Industry Co., Ltd.) were added to the obtained dispersion liquid, and a thermoreversible recording layer liquid was thus prepared.

Subsequently, the obtained thermoreversible recording layer liquid was applied over the support, then heated and dried, and subsequently stored at 65° C. for 24 hours so as to cross-link the resin, and a thermoreversible recording layer having a thickness of 10 μm was thus provided.

—Protective Layer—

A solution composed of 10 parts by mass of a urethane acrylate ultraviolet curable resin 75% by mass butyl acetate solution (UNIDIC C7-157, manufactured by Dainippon Ink and Chemicals, Incorporated) and 10 parts by mass of isopropyl alcohol was applied over the thermoreversible recording layer using a wire bar, then heated and dried, and subsequently cured by ultraviolet irradiation with a high-pressure mercury lamp of 80 W/cm, and a protective layer having a thickness of 3 μm was thus formed. In this manner, a thermoreversible recording medium of Example 11 was produced.

Comparative Example 5

A thermoreversible recording medium of Comparative Example 5 was produced in the same manner as in Example 11, except that 1.2 parts by mass of the $LaB_6$ 1.85% by mass dispersion solution (KHF-7A, manufactured by SUMITOMO METAL MINING CO., LTD.) as a light-heat conversion material was removed from the thermoreversible recording layer liquid and that 2.4 parts by mass of a phthalocyanine-based light-heat conversion material (YKR-3070, manufactured by Yamamoto Chemicals, Inc., maximum absorption peak: 810 nm) 5% by mass solution was added.

Example 12

<Production of Thermoreversible Recording Medium>

A thermoreversible recording medium whose color tone reversibly changed by heat between a transparent state and a color forming state was produced as follows.

—Support—

As a support, a white polyester film having a thickness of 125 μm (TETORON FILM U2L98W, manufactured by Teijin DuPont Films Japan Limited) was used.

—First Oxygen-insulating Layer—

Five parts by mass of a urethane-based adhesive (TM-567, manufactured by Toyo-Morton, Ltd.), 0.5 parts by mass of an isocyanate (CAT-RT-37, manufactured by Toyo-Morton, Ltd.) and 5 parts by mass of ethyl acetate were poured and sufficiently stirred to prepare a coating liquid for an adhesive layer.

Next, the coating liquid for an adhesive layer was applied over the support using a wire bar, then heated and dried at 80° C. for 1 minute. Thereafter, a silica vapor-deposited PET film (IB-PET-C, manufactured by Dai Nippon Printing Co., Ltd., oxygen permeability: 15 mL/($m^2$·day·MPa)) was affixed to the obtained product, which was followed by heating at 50° C. for 24 hours, and a first oxygen-insulating layer having a thickness of 12 μm was thus formed.

—Thermoreversible Recording Layer—

The thermoreversible recording layer of Example 1 was formed as in Example 1 on the first oxygen-insulating layer.

—Intermediate Layer—

Six parts by mass of an acrylic polyol resin 50% by mass solution (LR327, manufactured by MITSUBISHI RAYON CO., LTD.), 2.4 parts by mass of an isocyanate (CORONATE HL, manufactured by Nippon Polyurethane Industry Co., Ltd.) and 14 parts by mass of methyl ethyl ketone were poured and sufficiently stirred to prepare a coating liquid for an intermediate layer.

Next, the coating liquid for an intermediate layer was applied over the thermoreversible recording layer using a wire bar, then heated and dried at 90° C. for 1 minute and subsequently heated at 60° C. for 24 hours, and an intermediate layer having a thickness of 3 μm was thus formed.

—Second Oxygen-insulating Layer—

The same coating liquid for an adhesive layer as the one for the first oxygen-insulating layer was applied over the intermediate layer using a wire bar, then heated and dried at 80° C. for 1 minute. Thereafter, a silica vapor-deposited PET film (IB-PET-C, manufactured by Dai Nippon Printing Co., Ltd., oxygen permeability: 15 mL/($m^2$·day·MPa)) was affixed to the obtained product, which was followed by heating at 50° C. for 24 hours, and a second oxygen-insulating layer having a thickness of 12 μm was thus formed.

—Ultraviolet-Absorbing Layer—

The ultraviolet-absorbing layer of Example 1 was formed as in Example 1 on the second oxygen-insulating layer.

—Protective Layer—

A solution composed of 10 parts by mass of a urethane acrylate ultraviolet curable resin 75% by mass butyl acetate solution (UNIDIC C7-157, manufactured by Dainippon Ink and Chemicals, Incorporated) and 10 parts by mass of isopropyl alcohol was applied over the ultraviolet-absorbing layer using a wire bar, then heated and dried, and subsequently cured by ultraviolet irradiation with a high-pressure mercury lamp of 80 W/cm, and a protective layer having a thickness of 3 μm was thus formed.

—Sticky Agent Layer—

A composition composed of 50 parts by mass of an acrylic sticky agent (BPS-1109, manufactured by TOYO INK MFG. CO., LTD.) and 2 parts by mass of an isocyanate (D-170N, manufactured by MITSUI TAKEDA CHEMICALS, INC.) was sufficiently stirred to prepare a coating liquid for a sticky agent layer.

Next, the coating liquid for a sticky agent layer was applied, using a wire bar, over the surface of the support on the opposite side to the thermoreversible recording layer, then dried at 90° C. for 2 minutes, and a sticky agent layer having a thickness of 20 μm was thus formed. In this manner, a thermoreversible recording medium of Example 12 was produced.

<Evaluation of Laser Recording>

A laser diode apparatus equipped with a laser diode "LIMO25-F100-DL808" (central wavelength: 808 nm) was used as a laser diode light source as shown in FIG. 5, and an image was recorded on each of the recording media produced in Examples and Comparative Examples, adjusting the irradiation distance to 152 mm and the linear velocity to 1,000 mm/s. At that time, image recording was carried out with the recording energy set in the range of 5 mJ/mm$^2$ to 30 mJ/mm$^2$, and the recording energy with which the density was saturated was defined as "saturated recording energy".

As for erasure of the image, laser light was linearly scanned at intervals of 0.5 mm using the laser diode apparatus and adjusting the irradiation distance, the linear velocity and the spot diameter to 200 mm, 500 mm/s and 3.0 mm respectively. At that time, the laser output in Examples 1 to 5, 8 to 9, and 12 and Comparative Examples 1 and 3 was set at 14 W, and the laser output at Examples 6 to 7, and 10 and Comparative Examples 2 and 4 was set at 16 W.

<Light Resistance Evaluation 1

The background density of each of the recording media of Examples 1 to 10, and 12 and Comparative Examples 1 to 4 in an initial state was measured using a reflection densitometer "X-RITE 938". The results are shown in Table 1.

Subsequently, using an artificial sunlight irradiation apparatus manufactured by SERIC LTD., light irradiation was carried out for 12 hours under the conditions of 30° C., 80 RH % and 130 klx, then the background density of each recording medium was similarly measured using the reflection densitometer "X-RITE 938" and compared with the background density thereof in its initial state. The results are shown in Table 1. Parenthetically, the evaluation carried out here with the artificial sunlight is testing conducted in a forced manner, and the light resistance of thermoreversible recording media required by the market corresponds to resistance to light exposure for 12 hours performed by this apparatus.

Next, on each of the recording media of Examples 1 to 10, and 12 and Comparative Examples 1 to 4 before and after irradiated with light by the artificial sunlight irradiation apparatus, an image was recorded under the above-mentioned laser recording conditions, and the saturated recording energy in the initial state and the saturated recording energy after the light irradiation were evaluated. The results are shown in Table 1.

<Light Resistance Evaluation 2

Recording and erasure were repeatedly carried out 100 times on each of the thermoreversible recording media of Examples 6, 7 and 11 and Comparative Examples 2, 3 and 5 under the above-mentioned laser recording conditions and laser erasure conditions, then an image was recorded on each thermoreversible recording medium under the above-mentioned laser recording conditions using a spectrophotometer (U-4100, manufactured by Hitachi High-Technologies Corporation), and the saturated recording energy in the initial state was evaluated. The results are shown in Table 2.

Subsequently, using an artificial sunlight irradiation apparatus manufactured by SERIC LTD., light irradiation was carried out for 12 hours under the conditions of 30° C., 80 RH % and 130 klx, then an image was similarly recorded on each thermoreversible recording medium under the above-mentioned laser recording conditions, and the saturated recording energy after the light irradiation was evaluated. The results are shown in Table 2.

TABLE 1

| | Light-heat conversion material | Ratio (Y/X) | Light resistance evaluation 1: Background density: Initial | Background density: After light irradiation | Saturated recording energy (mJ/mm$^2$): Initial | Saturated recording energy (mJ/mm$^2$): After light irradiation |
|---|---|---|---|---|---|---|
| Ex. 1 | Inorganic, In particle form | 2.7 | 0.22 | 0.23 | 13.3 | 13.4 |
| Ex. 2 | Inorganic, In particle form | 2.8 | 0.21 | 0.22 | 13.1 | 13.2 |
| Ex. 3 | Inorganic, In particle form | 3.1 | 0.25 | 0.26 | 13.4 | 13.2 |
| Ex. 4 | Inorganic, In particle form | 8.3 | 0.20 | 0.21 | 13.2 | 13.0 |
| Ex. 5 | Inorganic, In particle form | 3.6 | 0.26 | 0.27 | 13.5 | 13.3 |
| Ex. 6 | Inorganic, In particle form | 2.7 | 0.22 | 0.23 | 15.6 | 15.7 |
| Ex. 7 | Inorganic, In particle form | 2.8 | 0.21 | 0.22 | 15.5 | 15.6 |
| Ex. 8 | Inorganic, In particle form | 3.1 | 0.22 | 0.22 | 13.3 | 13.3 |
| Ex. 9 | Inorganic, In particle form | 8.3 | 0.21 | 0.22 | 13.2 | 13.3 |
| Ex. 10 | Inorganic, In particle form | 3.6 | 0.22 | 0.23 | 11.9 | 12.0 |
| Ex. 12 | Inorganic, In particle form | 2.7 | 0.22 | 0.22 | 13.8 | 13.8 |
| Comp. Ex. 1 | Organic, In particle form | 3.3 | 0.21 | 0.30 | 13.1 | 17.0 |
| Comp. Ex. 2 | Organic, In particle form | 3.3 | 0.21 | 0.26 | 15.2 | 15.8 |
| Comp. Ex. 3 | Inorganic, In layer form | 3.1 | 0.24 | 0.25 | 13.2 | 13.1 |
| Comp. Ex. 4 | Inorganic, In particle form | 2.7 | 0.22 | 0.31 | 11.7 | 15.4 |

TABLE 2

| | Light-heat conversion material | Ratio (Y/X) | Light resistance evaluation 2 Saturated recording energy (mJ/mm$^2$): Initial | After light irradiation |
|---|---|---|---|---|
| Ex. 6 | Inorganic, In particle form | 2.7 | 15.7 | 15.8 |
| Ex. 7 | Inorganic, In particle form | 2.8 | 15.6 | 15.7 |
| Ex. 11 | Inorganic, In particle form | 2.7 | 15.2 | 15.3 |
| Comp. Ex. 2 | Organic, In particle form | 3.3 | 15.3 | 19.2 |

TABLE 2-continued

| | Light-heat conversion material | Ratio (Y/X) | Light resistance evaluation 2 Saturated recording energy ($mJ/mm^2$) Initial | After light irradiation |
|---|---|---|---|---|
| Comp. Ex. 3 | Inorganic, In layer form | 3.1 | 13.3 | Evaluation was impossible due to layer peeling. |
| Comp. Ex. 5 | Organic, Dissolved | 3.3 | 15.0 | 15.7 |

The results in Table 1 show that, regarding Examples 1 to 10, and 12, since particles of at least one of a metal boride and a metal oxide were used as the light-heat conversion material, interaction with the leuco dye did not arise when the light-heat conversion material was added into the recording layer, the background density and the absorbance of the light-heat conversion material did not greatly change after the light resistance evaluation, and favorable recording sensitivity was secured. Notably in Examples 1 to 5, 8 to 9, and 12, since the light-heat conversion material was present in the thermoreversible recording layer, higher sensitivity was secured than in Examples 6 to 7 where the light-heat conversion material was present in the light-heat conversion layer.

Meanwhile, regarding Comparative Examples 1 and 4, since an organic pigment was used as the light-heat conversion material and mixed with the leuco dye in the thermoreversible recording layer, the background density was high after the light resistance evaluation, and there was a great decrease in the absorbance of the light-heat conversion material, thereby making it impossible to secure sufficient recording sensitivity.

Also, the results in Table 2 show that, regarding Examples 6 and 7, the absorbance of the light-heat conversion material did not greatly change after the light resistance evaluation in which recording and erasure were repeatedly carried out 100 times, and sufficient recording sensitivity was secured.

Meanwhile, regarding Comparative Example 2, although an organic pigment was used as the light-heat conversion material, there was not a great decrease in the absorbance of the light-heat conversion material, as shown in Table 1, before recording and erasure were carried out, because the light-heat conversion material did not mix with the leuco dye in the thermoreversible recording layer; however, after recording and erasure had been repeatedly carried out 100 times, the light-heat conversion material mixed with the leuco dye and there was a great decrease in the absorbance of the light-heat conversion material after the light resistance evaluation, thereby making it impossible to secure sufficient recording sensitivity.

Regarding Comparative Example 3, there was a deficiency of adhesion between the light-heat conversion layer in the form of a layer, provided by vacuum vapor deposition, and the recording layer and the ultraviolet-absorbing layer, and consequently layer peeling arose after the repeated recording and erasure, thereby rendering the evaluation impossible.

Regarding Example 11, it was found that since particles of at least one of a metal boride and a metal oxide were used as the light-heat conversion material, this Example was superior in light resistance to Comparative Example 5 where an organic pigment was used as the light-heat conversion material.

Since a thermosensitive recording medium of the present invention includes, as a light-heat conversion material, particles of at least one selected from the group consisting of a hexaboride, a tungsten oxide compound, antimony tin oxide (ATO), indium tin oxide (ITO) and zinc antimonate, the thermosensitive recording medium has sufficient recording density and erasing capability, and is highly sensitive and superior in the light resistance and heat resistance of the light-heat conversion material. Accordingly, with the thermoreversible recording medium affixed to cardboard or to a container such as a plastic container, a high-contrast image can be repeatedly recorded onto and erased from the thermoreversible recording medium at high speed and in a noncontact manner; even in the case where the medium is exposed to light over a long period of time, decrease in recording sensitivity and erasure sensitivity caused by optical degradation of the light-heat conversion material can be suppressed; and thus the medium can be suitably used especially in product distribution and delivery systems.

What is claimed is:

1. A thermosensitive recording medium comprising:

a support;

an image recording layer on the support; and an inorganic material in particle form as a light-heat conversion material, wherein the inorganic material has a ratio of Y to X, represented by Y/X, of 2 or greater, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm, wherein the image recording layer comprises the light-heat conversion material or the light-heat conversion material is a separate layer attached to the image recording layer, wherein the light-heat conversion material is at least one selected from the group consisting of a hexaboride, a tungsten oxide compound and zinc antimonite and wherein the image recording layer comprises a leuco dye and a reversible developer.

2. The thermosensitive recording medium according to claim 1, wherein the light-heat conversion material comprises particles of at least one of a metal boride and a metal oxide.

3. The thermosensitive recording medium according to claim 1, wherein the image recording layer comprises the light-heat conversion material which can absorb light in the near-infrared region and convert the light to heat.

4. The thermosensitive recording medium according to claim 1, wherein the image recording layer is a thermoreversible recording layer.

5. The thermosensitive recording medium according to claim 4, wherein the thermoreversible recording layer can reversibly change into a transparent state and a colored state according to temperature.

6. The thermosensitive recording medium according to claim 5, wherein the thermoreversible recording layer contains a polymer and an organic low-molecular-weight material.

7. An image recording method comprising:

applying light to a thermosensitive recording medium so as to record an image on the thermosensitive recording medium, wherein the thermosensitive recording medium comprises a support; an image recording layer on the support; and an inorganic material in particle form as a light-heat conversion material, and wherein the inorganic material has a ratio of Y to X, represented by Y/X, of 2 or greater, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm, wherein the image recording layer comprises the light-heat conversion material, or the light-heat conversion material is a separate layer attached to the image recording layer, wherein the light-heat conversion material is at least one selected from the group consisting of a hexaboride, a tungsten oxide compound and zinc antimonite, and wherein the image recording layer comprises a leuco dye and a reversible developer.

8. An image processing method comprising:

applying light to a thermosensitive recording medium so as to carry out at least one of image recording and image erasure on the thermosensitive recording medium, wherein the thermosensitive recording medium comprises a support; a thermoreversible recording layer on the support; and an inorganic material in particle form as a light-heat conversion material, and wherein the inorganic material has a ratio of Y to X, represented by Y/X, of 2 or greater, where X denotes an average value of absorption intensities with respect to light having wavelengths in the range of 400 nm to 700 nm, and Y denotes a maximum value among absorption intensities with respect to light having wavelengths greater than 700 nm but smaller than or equal to 1,200 nm;

wherein the image recording layer comprises the light-heat conversion material, or the light-heat conversion material is a separate layer attached to either side of the image recording layer, wherein the light-heat conversion material is at least one selected from the group consisting of a hexaboride, a tungsten oxide compound and zinc antimonite, and wherein the image recording layer comprises a leuco dye and a reversible developer.

9. The image processing method according to claim 8, wherein the light applied to the thermosensitive recording medium is laser light.

10. The image processing method according to claim 9, wherein the laser light applied has a wavelength of 700 nm to 2,000 nm.

* * * * *